US008685489B1

(12) United States Patent
Wedding et al.

(10) Patent No.: US 8,685,489 B1
(45) Date of Patent: Apr. 1, 2014

(54) PLASMA-SHELL PDP

(75) Inventors: Carol Ann Wedding, Toledo, OH (US); Oliver M. Strbik, III, Holland, OH (US); Daniel K. Wedding, Toledo, OH (US); Jeffrey W. Guy, Toledo, OH (US); Robert P. Wenzlaff, Toledo, OH (US)

(73) Assignee: Imaging Systems Technology, Inc., Toledo, OH (US)

( * ) Notice: Subject to any disclaimer, the term of this patent is extended or adjusted under 35 U.S.C. 154(b) by 262 days.

(21) Appl. No.: 13/224,977

(22) Filed: Sep. 2, 2011

Related U.S. Application Data

(60) Continuation-in-part of application No. 12/108,716, filed on Apr. 24, 2008, now abandoned, which is a division of application No. 10/986,325, filed on Nov. 12, 2004, now abandoned.

(60) Provisional application No. 60/519,262, filed on Nov. 13, 2003.

(51) Int. Cl.
*B05D 5/06* (2006.01)

(52) U.S. Cl.
USPC ..... 427/64

(58) Field of Classification Search
USPC ..... 427/64
See application file for complete search history.

(56) References Cited

U.S. PATENT DOCUMENTS

| | | | | |
|---|---|---|---|---|
| 4,349,456 | A * | 9/1982 | Sowman | 428/402 |
| 6,100,633 | A * | 8/2000 | Okumura et al. | 313/486 |
| 6,975,068 | B2 * | 12/2005 | Green et al. | 313/582 |

* cited by examiner

*Primary Examiner* — Michael Cleveland
*Assistant Examiner* — Robert Vetere
(74) *Attorney, Agent, or Firm* — Donald K. Wedding

(57) ABSTRACT

A process for the manufacture of a hollow gas-filled Plasma-shells for a gas discharge device. The Plasma-shell is located in or on a substrate within the device with a dome side or flat side facing the viewing direction.

15 Claims, 14 Drawing Sheets

A-A Section View

Top View

B-B Section View

A-A Section View

Top View

B-B Section View

A-A Section View

Top View

B-B Section View

PLASMA-SHELL PDP

RELATED APPLICATIONS

This application is a continuation-in-part and division under 35 U.S.C. 120 of copending U.S. patent application Ser. No. 12/108,716 filed Apr. 24, 2008 which claims priority under 35 U.S.C. 120 as a divisional application which claims priority from U.S. application Ser. No. 10/986,325, now abandoned, filed Nov. 12, 2004, which claims priority under 35 U.S.C. 119(e) for Provisional Application Ser. No. 60/519,262, filed Nov. 13, 2003.

FIELD OF THE INVENTION

This invention relates to the production of small hollow shells such as Plasma-domes filled with an ionizable gas at a predetermined pressure and the use of gas filled shells in a gas discharge plasma display panel (PDP) device to create an enclosed pixel or cell structure. The construction of a PDP out of gas filled shells is known in the prior art. Such shells are referred to in the art as microspheres, spheres, beads, ampoules, capsules, bubbles, and so forth. In the practice of this invention, a gas filled Plasma-shell is used as a cell, sub-cell, pixel or sub-pixel in a PDP. In one embodiment as disclosed herein, the PDP is constructed of Plasma-domes alone or Plasma-domes in combination with other Plasma-shells such as Plasma-spheres and/or Plasma-discs.

BACKGROUND OF INVENTION

PDP Structures and Operation

In a gas discharge plasma display panel (PDP), a single addressable picture element is a cell, sometimes referred to as a pixel. In a multicolor PDP, two or more cells or pixels may be addressed as sub-cells or sub-pixels to form a single cell or pixel. As used herein cell or pixel means sub-cell or sub-pixel. The cell or pixel element is defined by two or more electrodes positioned in such a way so as to provide a voltage potential across a gap containing an ionizable gas. When sufficient voltage is applied across the gap, the gas ionizes to produce light. In an AC gas discharge plasma display, the electrodes at a cell site are coated with a dielectric. The electrodes are generally grouped in a matrix configuration to allow for selective addressing of each cell or pixel.

To form a display image, several types of voltage pulses may be applied across a plasma display cell gap. These pulses include a write pulse, which is the voltage potential sufficient to ionize the gas at the pixel site. A write pulse is selectively applied across selected cell sites. The ionized gas will produce visible light, or UV light which excites a phosphor to glow. Sustain pulses are a series of pulses that produce a voltage potential across pixels to maintain ionization of cells previously ionized. An erase pulse is used to selectively extinguish ionized pixels.

The voltage at which a pixel will ionize, sustain, and erase depends on a number of factors including the distance between the electrodes, the composition of the ionizing gas, and the pressure of the ionizing gas. Also of importance is the dielectric composition and thickness. To maintain uniform electrical characteristics throughout the display it is desired that the various physical parameters adhere to required tolerances. Maintaining the required tolerance depends on cell geometry, fabrication methods, and the materials used. The prior art discloses a variety of plasma display structures, a variety of methods of construction, and materials.

Examples of open cell gas discharge (plasma) devices include both monochrome (single color) AC plasma displays and multi-color (two or more colors) AC plasma displays. Also monochrome and multicolor DC plasma displays are contemplated.

Examples of monochrome AC gas discharge (plasma) displays are known in the prior art and include those disclosed in U.S. Pat. Nos. 3,559,190 (Bitzer et al.), 3,499,167 (Baker et al.), 3,860,846 (Mayer), 3,964,050 (Mayer), 4,080,597 (Mayer), 3,646,384 (Lay), and 4,126,807 (Wedding), all incorporated herein by reference.

Examples of multicolor AC plasma displays are known in the prior art and include those disclosed in U.S. Pat. Nos. 4,233,623 (Pavliscak), 4,320,418 (Pavliscak), 4,827,186 (Knauer et al.), 5,661,500 (Shinoda et al.), 5,674,553 (Shinoda et al.), 5,107,182 (Sano et al.), 5,182,489 (Sano), 5,075,597 (Salavin et al.), 5,742,122 (Amemiya et al.), 5,640,068 (Amemiya et al.), 5,736,815 (Amemiya), 5,541,479 (Nagakubi), 5,745,086 (Weber), and 5,793,158 (Wedding), all incorporated herein by reference.

This invention may be practiced in a DC gas discharge (plasma) display which areknown in the prior art, for example as disclosed in U.S. Pat. Nos. 3,886,390 (Maloney et al.), 3,886,404 (Kurahashi et al.), 4,035,689 (Ogle et al.), and 4,532,505 (Holz et al.), all incorporated herein by reference.

This invention will be described with reference to an AC plasma display. The PDP industry has used two different AC plasma display panel (PDP) structures, the two-electrode columnar discharge structure and the three-electrode surface discharge structure. Columnar discharge is also called co-planar discharge.

Columnar PDP

The two-electrode columnar or co-planar discharge plasma display structure is disclosed in U.S. Pat. Nos. 3,499,167 (Baker et al.) and 3,559,190 (Bitzer et al.). The two-electrode columnar discharge structure is also referred to as opposing electrode discharge, twin substrate discharge, or co-planar discharge. In the two-electrode columnar discharge AC plasma display structure, the sustaining voltage is applied between an electrode on a rear or bottom substrate and an opposite electrode on the front or top viewing substrate. The gas discharge takes place between the two opposing electrodes in between the top viewing substrate and the bottom substrate.

The columnar discharge PDP structure has been widely used in monochrome AC plasma displays that emit orange or red light from a neon gas discharge. Phosphors may be used in a monochrome structure to obtain a color other than neon orange.

In a multi-color columnar discharge PDP structure as disclosed in U.S. Pat. No. 5,793,158 (Wedding), phosphor stripes, or layers are deposited along the barrier walls and/or on the bottom substrate adjacent to and extending in the same direction as the bottom electrode. The discharge between the two opposite electrodes generates electrons and ions that bombard and deteriorate the phosphor thereby shortening the life of the phosphor and the PDP.

In a two electrode columnar discharge PDP as disclosed by Wedding '158, each light-emitting pixel is defined by a gas discharge between a bottom or rear electrode x and a top or front opposite electrode y, each cross-over of the two opposing arrays of bottom electrodes x and top electrodes y defining a pixel or cell.

Surface Discharge PDP

The three-electrode multi-color surface discharge AC plasma display panel structure is widely disclosed in the prior art including U.S. Pat. Nos. 5,661,500 (Shinoda et al.), 5,674,553, (Shinoda et al.), 5,745,086 (Weber), and 5,736,815 (Amemiya), all incorporated herein by reference.

In a surface discharge PDP, each light-emitting pixel or cell is defined by the gas discharge between two electrodes on the top substrate. In a multi-color RGB display, the pixels may be called sub-pixels or sub-cells. Photons from the discharge of an ionizable gas at each pixel or sub-pixel excite a photoluminescent phosphor that emits red, blue, or green light.

In a three-electrode surface discharge AC plasma display, a sustaining voltage is applied between a pair of adjacent parallel electrodes that are on the front or top viewing substrate. These parallel electrodes are called the bulk sustain electrode and the row scan electrode. The row scan electrode is also called a row sustain electrode because of its dual functions of address and sustain. The opposing electrode on the rear or bottom substrate is a column data electrode and is used to periodically address a row scan electrode on the top substrate. The sustaining voltage is applied to the bulk sustain and row scan electrodes on the top substrate. The gas discharge takes place between the row scan and bulk sustain electrodes on the top viewing substrate.

In a three-electrode surface discharge AC plasma display panel, the sustaining voltage and resulting gas discharge occurs between the electrode pairs on the top or front viewing substrate above and remote from the phosphor on the bottom substrate. This separation of the discharge from the phosphor minimizes electron bombardment and deterioration of the phosphor deposited on the walls of the barriers or in the grooves (or channels) on the bottom substrate adjacent to and/or over the third (data) electrode. Because the phosphor is spaced from the discharge between the two electrodes on the top substrate, the phosphor is subject to less electron bombardment than in a columnar discharge PDP.

Single Substrate PDP

There may be used a PDP structure having a so-called single substrate or monolithic plasma display panel structure having one substrate with or without a top or front viewing envelope or dome. Single-substrate or monolithic plasma display panel structures are known in the prior art and are disclosed by U.S. Pat. Nos. 3,646,384 (Lay), 3,652,891 (Janning), 3,666,981 (Lay), 3,811,061 (Nakayama et al.), 3,860,846 (Mayer), 3,885,195 (Amano), 3,935,494 (Dick et al.), 3,964,050 (Mayer), 4,106,009 (Dick), 4,164,678 (Biazzo et al.), and 4,638,218 (Shinoda), all incorporated herein by reference.

RELATED PRIOR ART

Spheres, Beads, Ampoules, Capsules

The construction of a PDP out of gas filled hollow microspheres is known in the prior art. Such microspheres are referred to as spheres, beads, ampoules, capsules, bubbles, shells, and so forth.

The following prior art relates to the use of microspheres in a PDP and are incorporated herein by reference.

U.S. Pat. No. 2,644,113 (Etzkorn) discloses ampoules or hollow glass beads containing luminescent gases that emit a colored light. In one embodiment, the ampoules are used to radiate ultra violet light onto a phosphor external to the ampoule itself.

U.S. Pat. No. 3,848,248 (MacIntyre) discloses the embedding of gas filled beads in a transparent dielectric. The beads are filled with a gas using a capillary. The external shell of the beads may contain phosphor.

U.S. Pat. No. 3,998,618 (Kreick et al.) discloses the manufacture of gas-filled beads by the cutting of tubing. The tubing is cut into ampoules and heated to form shells. The gas is a rare gas mixture, 95% neon, and 5% argon at a pressure of 300 Torr.

U.S. Pat. No. 4,035,690 (Roeber) discloses a plasma panel display with a plasma forming gas encapsulated in clear glass shells. Roeber used commercially available glass shells containing gases such as air, $SO_2$ or $CO_2$ at pressures of 0.2 to 0.3 atmosphere. Roeber discloses the removal of these residual gases by heating the glass shells at an elevated temperature to drive out the gases through the heated walls of the glass shell. Roeber obtains different colors from the glass shells by filling each shell with a gas mixture which emits a color upon discharge and/or by using a glass shell made from colored glass.

U.S. Pat. No. 4,963,792 (Parker) discloses a gas discharge chamber including a transparent dome portion.

U.S. Pat. No. 5,326,298 (Hotomi) discloses a light emitter for giving plasma light emission. The light emitter comprises a resin including fine bubbles in which a gas is trapped. The gas is selected from rare gases, hydrocarbons, and nitrogen.

Japanese Patent 11238469A, published Aug. 31, 1999, by Tsuruoka Yoshiaki of Dainippon discloses a plasma display panel containing a gas capsule. The gas capsule is provided with a rupturable part which ruptures when it absorbs a laser beam.

U.S. Pat. No. 6,545,422 (George et al.) discloses a light-emitting panel with a plurality of sockets with spherical or other shape micro-components in each socket sandwiched between two substrates. The micro-component includes a shell filled with a plasma-forming gas or other material. The light-emitting panel may be a plasma display, electroluminescent display, or other display device.

Also incorporated herein by reference are U.S. Pat. Nos. 6,646,388 (George et al.), 6,620,012 (Johnson et al.), 6,612,889 (Green et al.), and 6,570,335 (George et al.).

Also incorporated herein by reference are U.S. Patent Application Publication Nos. 2004/0004445 (George et al.), 2003/0164684 (Green et al.), 2003/0094891 (Green et al.), and 2003/0090213 (George et al.).

RELATED PRIOR ART

Methods of Producing Microspheres

Numerous methods and processes to produce hollow shells or microspheres are well known in the prior art. Microspheres have been formed from glass, ceramic, metal, plastic, and other inorganic and organic materials. Varying methods for producing shells and microspheres have been disclosed and practiced in the prior art.

Some methods used to produce hollow glass microspheres incorporate a so-called blowing gas into the lattice of a glass while in frit form. The frit is heated and glass bubbles are formed by the in-permeation of the blowing gas. Microspheres formed by this method have diameters ranging from about 5 μm to approximately 5,000 μm. This method produces shells with a residual blowing gas enclosed in the shell.

Methods of manufacturing glass frit for forming hollow microspheres are disclosed by U.S. Pat. Nos. 4,017,290 (Budrick et al.) and 4,021,253 (Budrick et al.). Budrick et al. '290 discloses a process whereby occluded material gasifies to form the hollow microsphere.

Hollow microspheres are disclosed in U.S. Pat. No. 5,500,287 (Henderson), and U.S. Pat. No. 5,501,871 (Henderson). According to Henderson '287, the hollow microspheres are formed by dissolving a permeant gas (or gases) into glass frit particles. The gas permeated frit particles are then heated at a high temperature sufficient to blow the frit particles into hollow microspheres containing the permeant gases. The gases may be subsequently out-permeated and evacuated from the hollow shell as described in step D in column 3 of Henderson '287. Henderson '287 and '871 are limited to gases of small molecular size. Some gases such as xenon, argon, and krypton used in plasma displays may be too large to be permeated through the frit material or wall of the microsphere. Helium which has a small molecular size may leak through the microsphere wall or shell.

U.S. Pat. No. 4,257,798 (Hendricks et al.) discloses a method for manufacturing small hollow glass spheres filled with a gas introduced during the formation of the spheres, and is incorporated herein by reference. The gases disclosed include argon, krypton, xenon, bromine, DT, hydrogen, deuterium, helium, hydrogen, neon, and carbon dioxide. Other Hendricks patents for the manufacture of glass spheres include U.S. Pat. Nos. 4,133,854 (Hendricks) and 4,163,637 (Hendricks), both incorporated herein by reference. Hendricks '798 is also incorporated herein by reference.

Microspheres are also produced as disclosed in U.S. Pat. No. 4,415,512 (Torobin), incorporated herein by reference. This method by Torobin comprises forming a film of molten glass across a blowing nozzle and applying a blowing gas at a positive pressure on the inner surface of the film to blow the film and form an elongated cylinder shaped liquid film of molten glass. An inert entraining fluid is directed over and around the blowing nozzle at an angle to the axis of the blowing nozzle so that the entraining fluid dynamically induces a pulsating or fluctuating pressure at the opposite side of the blowing nozzle in the wake of the blowing nozzle. The continued movement of the entraining fluid produces asymmetric fluid drag forces on a molten glass cylinder which close and detach the elongated cylinder from the coaxial blowing nozzle. Surface tension forces acting on the detached cylinder form the latter into a spherical shape which is rapidly cooled and solidified by cooling means to form a glass microsphere.

In one embodiment of the above method for producing the microspheres, the ambient pressure external to the blowing nozzle is maintained at a super atmospheric pressure. The ambient pressure external to the blowing nozzle is such that it substantially balances, but is slightly less than the blowing gas pressure. Such a method is disclosed by U.S. Pat. No. 4,303,432 (Torobin) and WO 8000438A1 (Torobin), both incorporated herein by reference.

The microspheres may also be produced using a centrifuge apparatus and method as disclosed by U.S. Pat. No. 4,303,433 (Torobin) and WO8000695A1 (Torobin), both incorporated herein by reference.

Other methods for forming microspheres of glass, ceramic, metal, plastic, and other materials are disclosed in other Torobin patents including U.S. Pat. Nos. 5,397,759; 5,225,123; 5,212,143; 4,793,980; 4,777,154; 4,743,545; 4,671,909; 4,637,990; 4,582,534; 4,568,389; 4,548,196; 4,525,314; 4,363,646; 4,303,736; 4,303,732; 4,303,731; 4,303,603; 4,303,431; 4,303,730; 4,303,729; and 4,303,061, all incorporated herein by reference.

U.S. Pat. No. 3,607,169 (Coxe) discloses an extrusion method in which a gas is blown into molten glass and individual shells are formed. As the shells leave the chamber, they cool and some of the gas is trapped inside. Because the shells cool and drop at the same time, the shell shells do not form uniformly. It is also difficult to control the amount and composition of gas that remains in the shell.

U.S. Pat. No. 4,349,456 (Sowman), incorporated herein by reference, discloses a process for making ceramic metal oxide microspheres by blowing a slurry of ceramic and highly volatile organic fluid through a coaxial nozzle. As the liquid dehydrates, gelled microcapsules are formed. These microcapsules are recovered by filtration, dried, and fired to convert them into microspheres. Prior to firing, the microcapsules are sufficiently porous that, if placed in a vacuum during the firing process, the gases can be removed and the resulting microspheres will generally be impermeable to ambient gases. The shells formed with this method may be easily filled with a variety of gases and pressurized from near vacuums to above atmosphere. This is a suitable method for producing microspheres. However, shell uniformity may be difficult to control.

U.S. Patent Application Publication 2002/0004111 (Matsubara et al.), incorporated herein by reference discloses a method of preparing hollow glass microspheres by adding a combustible liquid (kerosene) to a material containing a foaming agent.

Methods for forming microspheres are also disclosed in U.S. Pat. Nos. 3,848,248 (MacIntyre), 3,998,618 (Kreick et al.), and 4,035,690 (Roeber), discussed above and incorporated herein by reference.

Methods of manufacturing hollow microspheres are disclosed in U.S. Pat. Nos. 3,794,503 (Netting), 3,796,777 (Netting), 3,888,957 (Netting), and 4,340,642 (Netting et al.), all incorporated herein by reference.

Other prior art methods for forming microspheres are disclosed in the prior art including U.S. Pat. Nos. 3,528,809 (Farnand et al.), 3,975,194 (Farnand et al.), 4,025,689 (Kobayashi et al.), 4,211,738 (Genis), 4,307,051 (Sargeant et al.), 4,569,821 (Duperray et al.) 4,775,598 (Jaeckel), and 4,917,857 (Jaeckel et al.), all of which are incorporated herein by reference.

These references disclose a number of methods which comprise an organic core such as naphthalene or a polymeric core such as foamed polystyrene which is coated with an inorganic material such as aluminum oxide, magnesium, refractory, carbon powder, and the like. The core is removed such as by pyrolysis, sublimation, or decomposition and the inorganic coating sintered at an elevated temperature to form a sphere or microsphere.

Farnand et al. '809 discloses the production of hollow metal spheres by coating a core material such as naphthalene or anthracene with metal flakes such as aluminum or magnesium. The organic core is sublimed at room temperature over 24 to 48 hours. The aluminum or magnesium is then heated to an elevated temperature in oxygen to form aluminum or magnesium oxide.

The core may also be coated with a metal oxide such as aluminum oxide and reduced to metal. The resulting hollow spheres are used for thermal insulation, plastic filler, and bulking of liquids such as hydrocarbons.

Farnand '194 discloses a similar process comprising polymers dissolved in naphthalene including polyethylene and polystyrene. The core is sublimed or evaporated to form hollow spheres or microballoons.

Kobayashi et al. '689 discloses the coating of a core of polystyrene with carbon powder. The core is heated and decomposed and the carbon powder heated in argon at 3000° C. to obtain hollow porous graphitized spheres.

Genis '738 discloses the making of lightweight aggregate using a nucleus of expanded polystyrene pellet with outer layers of sand and cement.

Sargeant et al. '051 discloses the making of light weight-refractories by wet spraying core particles of polystyrene with an aqueous refractory coating such as clay with alumina, magnesia, and/or other oxides. The core particles are subject to a tumbling action during the wet spraying and fired at 1730° C. to form porous refractory.

Duperray et al. '821 discloses the making of a porous metal body by suspending metal powder in an organic foam which is heated to pyrolyze the organic and sinter the metal.

Jaeckel '598 and Jaeckel et al. '857 disclose the coating of a polymer core particle such as foamed polystyrene with metals or inorganic materials followed by pyrolysis on the polymer and sintering of the inorganic materials to form the sphere. Both disclose the making of metal spheres such as copper or nickel spheres which may be coated with an oxide such as aluminum oxide. Jaeckel et al. '857 further discloses a fluid bed process to coat the core.

SUMMARY OF INVENTION

This invention relates to the production of small hollow shells called Plasma-shells filled with an ionizable gas at a suitable pressure for use in a gas discharge plasma display panel (PDP) device to create an enclosed pixel or cell structure. As used herein, Plasma-shell includes a Plasma-sphere, Plasma-disc, and Plasma-dome filled with an ionizable gas at a predetermined pressure for use in a PDP. This invention is particularly disclosed with the production of Plasma-domes and the use of Plasma-domes as pixels or cells in a PDP.

The Plasma-shell may be of any suitable volumetric shape or geometric configuration to encapsulate the ionizable gas independently of the PDP or PDP substrate. The volumetric and geometric shapes include but are not limited to spherical, oblate spheroid, prolate spheroid, capsular, elliptical ovoid, egg shape, bullet shape, and pear and/or tear drop. Plasma-shell includes not by way of limitation Plasma-spheres, Plasma-discs and Plasma-domes.

A Plasma-sphere is a hollow spherical shell with relatively uniform shell thickness. The shell is typically composed of an inorganic material and is filled with a selected ionizable gas at a desired pressure. The gas is selected to produce visible, UV, and/or infrared discharge when a voltage is applied. The shell material is selected to optimize dielectric properties and optical transmissivity. Additional beneficial materials may be added to the inside or outside surface of the shell including secondary electron emission materials such as magnesium oxide. Luminescent substances may also be added. The magnesium oxide and other materials including luminescent substances may also be added directly to the shell material.

A Plasma-disc is the same as a Plasma-sphere in material composition and gas selection. It differs in geometric shape from the Plasma-sphere in that it is relatively flat on at least two opposing sides, i.e., top and bottom. A Plasma-shell such as a Plasma-sphere may be flattened on at least two sides to form a Plasma-disc, such as by applying pressure simultaneously to the top and bottom of the shell using two opposing substantially flat and ridged members, either of which may be at ambient temperature or heated. Each of the other four sides of the Plasma-disc may be flat or round. The plasma-disc may be of any suitable geometric shape so long as two opposing sides, i.e., top and bottom, are relatively flat. Such geometric shape includes a circular or elliptical shape where the top and bottom are flat and the sides and ends are rounded. The geometric shape of the Plasma-disc may be rectangular, square, or trapezoid where opposing sides and/or ends are flat. Other geometric Plasma-disc shapes are contemplated including triangular, pentagon, hexagon, and so forth.

A Plasma-dome is the same as a Plasma-sphere and a Plasma-disc in material composition and ionizable gas selection. It differs in volumetric shape in that one side is domed and the opposite side is flat. A Plasma-shell such as a Plasma-sphere may be flattened on one or more other sides to form a Plasma-dome by applying pressure and/or heat simultaneously to the top and bottom of the shell using one substantially flat and ridged member and one substantially elastic member, either of which may be at ambient temperature or heated. A dome may also be formed by applying heat and/or pressure to only one or more sides to be flattened. The geometric shape of the Plasma-dome may be rectangular, square, or trapezoid where selected sides and/or ends are flat and at least one side is a dome. Other geometric Plasma-dome shapes are contemplated including triangular, pentagon, hexagon, and so forth.

In the practice of this invention, the Plasma-domes may be produced by any suitable means. In accordance with one embodiment of this invention, a solid or semi-solid organic core of predetermined geometric dome shape is coated with a suspension of inorganic particles in an aqueous and/or organic binder. The coated dome core is heated to a temperature sufficient to remove the organic core and binder and form a porous bisque dome shaped shell of inorganic particles with a hollow center. In this bisque state, the dome shaped shell is submerged in an atmosphere of ionizable gas at a predetermined pressure, the gas being selected for suitable operation of a gas discharge PDP device. The gas-submerged bisque shell is heated to an elevated temperature sufficient to sinter the shell so as to trap and/or form an impervious seal and retain the gas inside the shell.

At the elevated temperature, the pressure of the ionizable gas inside the shell is maintained at a predetermined pressure greater than the desired final shell pressure required for use in the PDP. After the shell is sintered and sealed in situ while submerged in the gas and cooled, the gas pressure inside the cooled Plasma-shell decreases to the required PDP pressure. The result is a clear impervious Plasma-dome containing an ionizable gas at a predetermined pressure for use in a gas discharge PDP.

The organic core is typically selected from one or more organic materials including polymeric materials having low molecular weight, low vapor pressure, and low boiling temperature. The organic core is also selected based on the chemical and physical properties of the selected inorganic particles and the processing conditions including temperatures required to form the Plasma-shells. The selected organic core must have the proper vaporization, pyrolization, sublimation, oxidation, and/or decomposition properties without leaving a harmful carbonaceous or other residue which would interfere with the use and operation of the Plasma-shell in a PDP. The solid organic core comprises any suitable solid organic or solid polymeric material which vaporizes, pyrolyses, sublimes, oxidizes, and/or decomposes at a selected temperature without leaving a detectable carbonaceous or other deleterious residue. The contemplated solid organic material include solid polymeric materials. The core may be solid or partially solid.

Examples of suitable organic cores are the polyacrylates including polyakylacrylates such as polymethylacrylate, polyethylacrylate, polypropylacrylate, and polybutylacrylate.

The organic core may also be selected from alkyl esters of acrylic acid. These include the alkyl acrylate esters such as methylacrylate, ethylacrylate, propylacrylate, butylacrylate, pentylacrylate, hexylacrylate, 2-ethylhexylacrylate. Also the esters of methacrylic acid such as methyl (meth) acrylate, ethyl (meth)acrylate, propyl (meth)acrylate, butyl(meth) acrylate, amyl(meth)acrylate, hexyl(meth)acrylate, heptyl (meth)acrylate, octyl(meth)acrylate, nonyl(meth)acrylate, decyl(meth)acrylate, and 2-ethylhexyl(meth)acrylate.

Other suitable organic cores include polystyrenes, and substituted polystyrenes as set forth below. Also there may be used polyvinyl acetate, polyvinyl alcohol, polybutyrol, cellulose ester, and cellulose nitrate.

The selected polystyrene including substituted polystyrenesis typically foamed, expanded, or pre-puffed. Solid poly (alpha-substituted) styrenes are particularly suitable and include those styrenes having the structure:

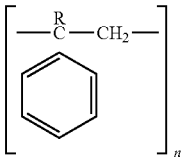

where n is an integer greater than 1 and R is selected from alkyls of about 6 carbons or less, e.g., methyl, ethyl, propyl, butyl, isobutyl, isopropyl, pentyl, isopentyl, neopentyl and hexyl.

The inorganic particles are selected from any finely divided particulates including powders suitable for incorporation with the binder to form the suspension. Examples of inorganic particles include materials containing oxides, carbides, nitrides, nitrates, silicates, aluminates, phosphates, borates and other compounds of metals and/or metalloids such as silicon, germanium, aluminum, gallium, magnesium, titanium, zirconium, zinc, chromium, and so forth.

Some specific examples include particles of aluminum oxide, magnesium oxide, chromium oxide, zirconium oxide, silicon carbide, silicon nitride, ceramic, glass, glass ceramic, refractory, fused silica, quartz, and mixtures thereof.

Mixtures of inorganic particles may be used to coat the organic core. For production of metal-containing ceramic hollow shells, it is possible to use metal powders and the corresponding metal oxide powders or combinations thereof. Elements which form easily reducible oxides, such as Fe, Ni, Co, Cu, W, and Mo, can be used in the form of the oxides and reduced to elemental metal at least in part during the sintering process.

Inorganic metallic powder particles may be selected from metals of the group Fe, Co, Ni, Cu, W, Mo, noble metals (e.g. gold, platinum, iridium) and hard metals (e.g. titanium and tantalum).

The inorganic particles are added to an aqueous and/or organic binder medium to form a suspension, slurry, colloidal dispersion, mixture, solution, or the like. Suspension as used herein includes slurry, dispersion, mixture, solution, or the like. The inorganic particles have a typical particle size of about 0.1 to 10 microns. The organic binder may be selected from the same materials listed above for the organic core.

The aqueous and/or organic suspension may include a suitable solvent such as the alcohol solvent series or ethers such as tetrahydrofuran (THF), dimethylethylene glycol (Diglyne), and diethylene glycol monoethyl ether. Other solvents include diacetone alcohol, n-butyl acetate, 2-nitrol propane, the carbitols, and 2-ethoxy-ethanol-1.

The aqueous and/or organic suspension may also include suitable wetting and/or dispersing agents may be incorporated into the suspension. Some selected agents include lecithins, mixed fatty acid esters of phosphatidyl choline, polyethylene sorbitol oleate laurate, polyethylene glycol lauryl ether, diethylene glycol monostearate, polyacrylic acid, ammonium salt of polyacrylic acid, and the like.

The processes or methods described herein may be used to produce small hollow Plasma-shells such as Plasma-spheres, Plasma-discs and/or Plasma-domes filled with ionizable gas for use in a display device. The Plasma-shells produced in accordance with these processes have a uniform shell thickness and may be filled with an ionizable gas of a predetermined composition and pressure. Additionally the Plasma-shell may contain luminescent materials and/or other secondary electron emission materials such as magnesium oxide to enhance the gas discharge of the PDP.

In accordance with this invention, a solid organic core such as a solid polymeric material of a predetermined geometric shape is coated with an aqueous and/or organic suspension, slurry, colloidal dispersion, or the like of inorganic particles. The green shell of coated particles on the core is heated at a temperature sufficient to remove the organic core by vaporization, pyrolization, sublimation, oxidation, and/or decomposition so as to form a porous bisque shell of inorganic particles with a hollow center. The porous bisque shell is submerged in an atmosphere of selected ionizable gas at a predetermined pressure, the gas being selected for the operation of a gas discharge PDP device. The gas-submerged bisque shell is then heated to an elevated temperature sufficient to sinter the shell and form an impervious shell seal so as to trap and retain the gas inside the shell.

Before sintering and gas filling, the bisque shells may be baked out under vacuum to remove any undesired impurities including organic residue(s) or other contaminants. This is typically done under vacuum at about $10^{-4}$ to $10^{-8}$ mm of Hg at about 200° C. to 400° C. The bake-out under vacuum is about 4 to 10 hours.

At the elevated sintering and shell sealing temperature, the pressure of the ionizable gas inside the shell is maintained at a pressure greater than the desired final shell pressure required for use in the PDP. After the shell is sintered, sealed and cooled, the pressure inside the shell decreases to the predetermined and required PDP pressure. The result is an impervious Plasma-shell containing the ionizable gas at a predetermined pressure for use in a gas discharge PDP.

The ionizable gas may be selected from any gas or mixtures of gases suitable for the operation of a plasma display panel. These gases are discussed hereinafter and include helium, argon, xenon, krypton, neon, excimers, and other gases.

The organic core particles are coated with the aqueous and/or organic suspension by any suitable means including spraying, dipping, tumbling, electrostatic deposition, powder bed, fluid bed, and the like.

In accordance with one embodiment of this invention, a fluid bed process is used to coat the organic cores. Expanded, foamed, or blown polystyrene core particles with a diameter of about 25 to 3000 microns are charged into a fluidized bed. A coating suspension of inorganic particles is introduced into the top of the fluidized bed formed by the foamed polystyrene core particles. The duration of the coating process depends on the required shell thickness and the flow rate and temperature of the fluidizing gas. The gas is typically heated air at about 70° C. to 130° C. introduced at the bottom of the bed counterflow to the flow of the suspension introduced at the top of the fluid bed. The time required to coat the core particles in the fluid bed depends upon the required shell thickness, the temperature, and rate of flow of the fluidizing gas.

Water may be added to the aqueous and/or organic binder suspension as needed. The aqueous suspension typically has about 10% to 40% by weight inorganic particles contained in the suspension.

The Plasma-shell may be of any suitable geometric shape including a Plasma-sphere, Plasma-disc, or Plasma-dome. The final shape of the Plasma-shell may be determined after processing, or may be determined by shaping the organic cores or selecting the shape of the cores before or after coating. The processing illustrated in FIGS. 6A, 6B, 6C may be used to form a Plasma-dome, or form dome shaped cores by applying heat and/or pressure to flatten one or more sides while leaving one side as a dome. A core may be shaped into a dome by selectively applying heat to a side so as to flatten the side.

The suspension of inorganic particles is formulated such that the thickness of the inorganic coating will have an adequate strength in the green state so that the green shell of inorganic particles will not be deformed when the organic core is heated and removed. The polystyrene core particles are typically coated such that the sintered and sealed Plasma-shell has a thickness of about 10 to 200 microns.

The coated organic core is heated to pyrolyze, vaporize, or otherwise remove the organic core. The pyrolyzed or vaporized core escapes through the porous shell. There remains a self-supporting hollow porous bisque shell.

Depending upon the nature of the selected inorganic particles, removal of the coated organic core and binder may be carried out in air, oxygen, inert gas or under reducing conditions. Depending on the selected organic core, the removal by pyrolysis, vaporization, sublimation, oxidation, and/or decomposition of the organic core requires heating for about 1 to 6 hours at a temperature of about 200° C. to about 600° C.

In some embodiments, the strength of the shell may be increased by conducting the removal, of the core, i.e., pyrolysis, vaporization, etc. under oxidizing conditions such as in an oxygen rich environment so that any residual carboneous material is oxidized.

The heating at 200° C. to 600° C. serves to remove a portion if not all of the organic core. This is followed by heating the shell at a temperature of about 600° C. to 1200° C. for about 1 to 5 hours to remove any residual core and to strengthen the shell which is in a porous bisque state. This temperature must be sufficient to remove any residual core and strengthen the bisque shell, but below the sintering temperature of the shell. The heating and removal of the core, and forming of the bisque may be carried out in the same unit, such as in a fluidized bed reactor. Alternatively, it may be desirable to process the higher temperature bisque formation in a separate unit, such as a rotary kiln or a raking furnace. The atmosphere in the furnace unit is determined in consideration of the inorganic material used to form the shell. During the bisque formation, the shell may be heated in a vacuum, under oxidizing or reducing conditions or in an inert gas environment.

The hollow shells may be agitated to prevent them from sticking to each other during the sintering. The same result may be produced by coating the outer surface of the shells with an inert powder which at the temperatures employed will not undergo a chemical or physical reaction with the material of the hollow shell. After the sintering treatment such inert powders may be removed from the hollow shells by mechanical or chemical processing. Depending upon the material of the hollow shells, suitable inert powders include carbon, aluminum hydroxide, or chalk.

DETAILED DESCRIPTIONS AND EMBODIMENTS OF THE INVENTION

Figure 1:
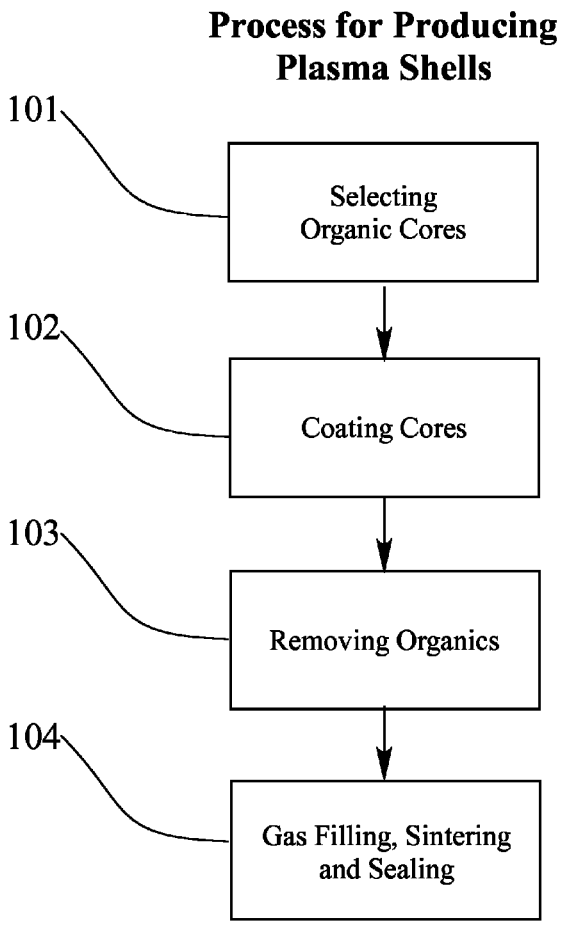
FIG. 1 is a block diagram of a process for producing Plasma-shells for use as pixel elements in a plasma display.

FIG. 1 shows the process steps to produce shells possessing the desired characteristics for use as the light-emitting element of a gas discharge plasma display device (PDP).

In Step 101, solid organic cores of predetermined geometric shape and size are selected by sieve or other means to produce the desired inner diameter and geometric shape of the shell. To produce Plasma-domes, the cores may be dome shaped. Typically the cores are selected with a diameter of 25 to 50 percent greater than the desired Plasma-shell diameter as the slurry of particles will tend to shrink as it is fired. The organic core may be selected based on geometric shape and density. Low density polystyrene beads of a predetermined shape are suitable for this process. Although sieving may be used as the first process step, the sieving may be repeated later in the process, for example after the formation of the bisque shells.

In Step 102, the organic core particles are coated with an aqueous and/or organic suspension of inorganic particles, to form a green shell.

In one preferred embodiment, the inorganic particles are selected based on transmissivity to light after sintering. This may include inorganic materials selected from metal compounds, metalloid compounds, and ceramics with various optical cutoff frequencies to produce various colors. One preferred material contemplated for this application is aluminum oxide. Aluminum oxide is transmissive to light over a broad range from the UV range to the IR range. Because aluminum oxide is transmissive in the UV range, luminescent substances such as phosphor may be applied to the exterior of the Plasma-shell to be excited by the UV through the shell. The application of luminescent substances to the exterior of the shell is described hereinafter.

In Step 103 of FIG. 1, the organic core is removed by heating to a temperature of about 200° C. to 600° C., leaving only the bisque shell of inorganic particles with a hollow center. This may be further heated to 600° C. to 1200° C. to further strengthen the bisque shell.

In Step 104, the porous bisque shells are filled with ionizable gas, sintered, and sealed at an elevated temperature typically 1500° C. or higher. In the case of aluminum oxide, the sintering and sealing temperature is around 1600° C. To completely seal the shell, this temperature is held for about 6 hours or more. After this time, the shell is completely sealed and the selected gas is retained inside the shell. As the shells are cooled, the gas pressure in the shell decreases.

The shells may be baked out under vacuum before gas fill and sintering. The shells are placed in a vacuum oven which is purged and filled with the selected ionizable gas or mixture of ionizable gases, such as neon, xenon, helium, argon, krypton or a mixture of these or other selected gases. As disclosed herein, numerous gas compositions, mixtures, and concentrations are contemplated including the excimers.

Figure 2:
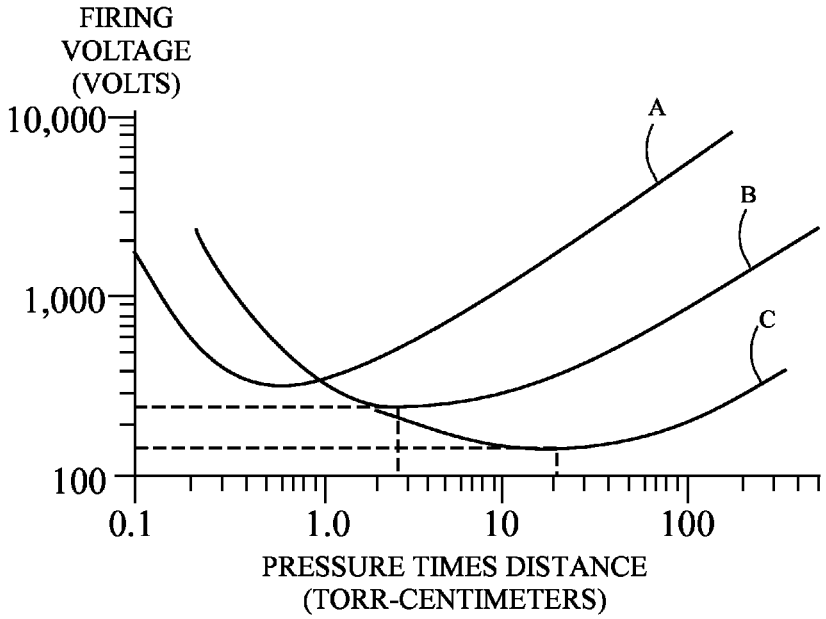
FIG. 2 shows hypothetical Paschen curves for three typical hypothetical gases.

Each gas composition or mixture has a unique curve called the Paschen curve as illustrated in FIG. 2. The Paschen curve is a graph of the breakdown voltage verses the product of the pressure times the discharge distance. It is usually given in Torr-centimeters. As can be seen from the illustration in FIG. 2, the gases typically have a saddle region in which the voltage is at a minimum. Often it is desirable to choose pressure and distance in the saddle region to minimize the voltage. The distance is the gap between electrodes. The gas pressure at ambient room temperature inside the Plasma-shell is selected in accordance with this gap. Knowing the desired pressure $P_1$ at ambient temperature $T_1$, one can calculate the pressure at the heating temperatures using the ideal gas law where $$P_1/T_1=P_2/T_2 \text{ such that}$$

$$P_1=P_2T_1/T_2$$

$P_2$ is the desired pressure of the gas inside a sealed shell at ambient temperature $T_2$, $T_1$ is the sealing and gas filing temperature, and $P_1$ is the gas pressure at $T_1$. For example, if a shell is filled with gas at 1600° C., the desired gas is maintained at a pressure of about 6 times greater then the desired pressure.

When using an organic core, multiple coatings of suspension may be applied. These are referred to herein as precoatings. Successive coatings of identical materials or different materials may be applied to the core. In one embodiment, a first coating or layer of secondary electron emitting material (such as magnesium oxide) is applied to the core. The secondary electron emitting material is then coated by a luminescent material which is then coated by the aqueous suspension of inorganic shell material. The secondary electron emitting material and/or phosphor may be applied in a suitable suspension and will be exposed to the same temperature cycles as the shell material. These must be able to withstand the temperature cycles and withstand chemical reaction with other coatings. In the method shown in FIG. 3, one or more precoatings of various substances may be applied as method Step 301*a* between the core selection Step 301 and the coating Step 302.

Figure 4:
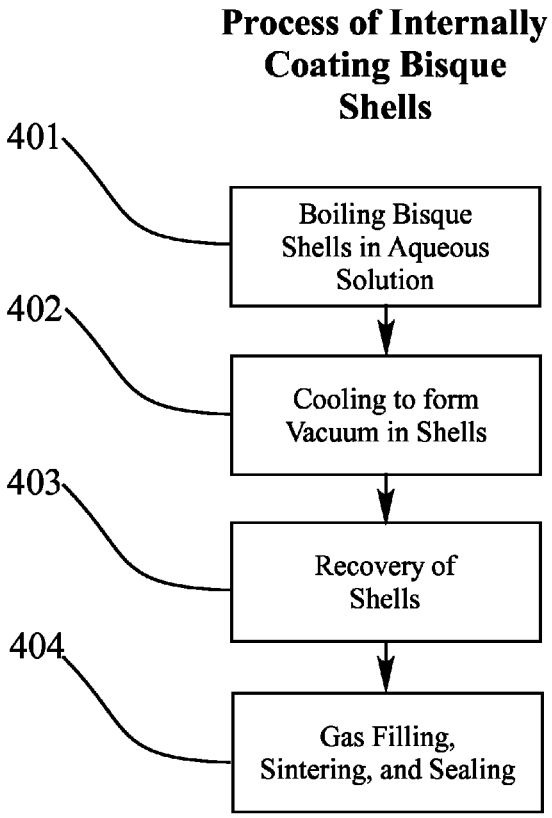
FIG. 4 is a block diagram of a process for internally coating bisque shells.

In another embodiment hereof, as illustrated in FIG. 4, there is shown a process for coating the interior of the Plasma-shell. In Step 401, bisque shells are boiled in an aqueous suspension. As the bisque shells are heated, the gas within the hollow shell chamber expands and evacuates the chamber. In process Step 402, the solution is cooled, a vacuum is formed in the shell chamber and the aqueous solution is drawn in. By air drying or other heat cycles, the aqueous and/or organic binder solution is evaporated in Step 403 leaving a coating inside the shell. In Step 404, the shell is gas filled, sintered, and sealed. This process results in a layer on the inside of the shell. Because this coating method is applied after the bisque shell is formed, it may be used in conjunction with any suitable shell forming processes that produce a porous bisque shell.

Figure 5:
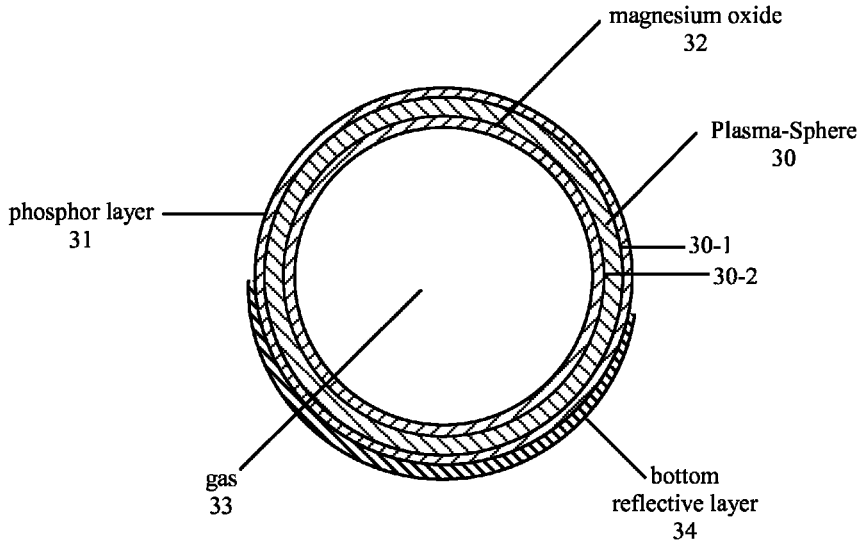
FIG. 5 shows a cross-section view of a Plasma-shell embodiment.
Figure 10:
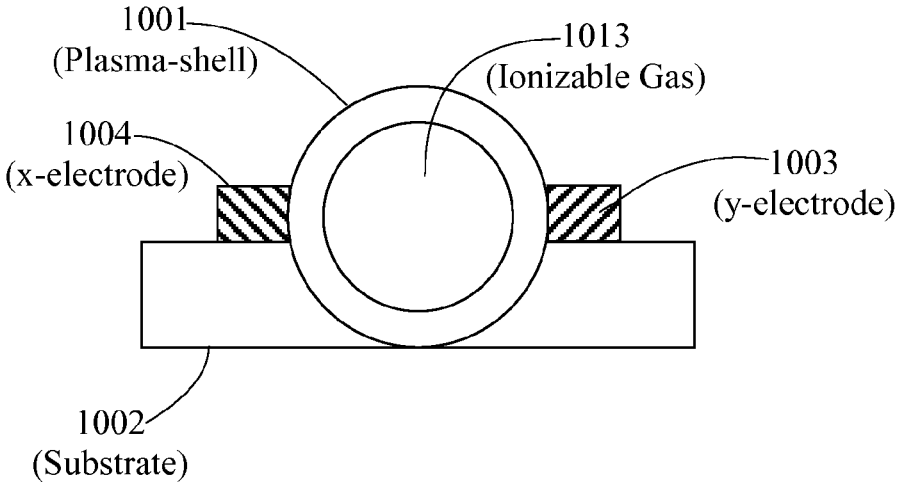
FIG. 10 shows a Plasma-shell mounted on a substrate as a PDP pixel element.

FIG. 5 shows a cross-sectional view of another embodiment and mode of a Plasma-sphere 30 with external surface 30-1 and internal surface 30-2, an external phosphor layer 31, internal magnesium oxide layer 32, ionizable gas 33, and an external bottom reflective layer 34. The Plasma-sphere 30 can be positioned in a well on a substrate as shown in FIG. 10. Although a Plasma-sphere is illustrated in FIG. 5 and FIG. 10, other Plasma-shells such as Plasma-disc or Plasma-dome may be substituted.

The bottom reflective layer 34 is optional and, when used, will typically cover about half of the phosphor layer 31 on the external surface 30-1. This bottom reflective layer 34 will reflect light upward that would otherwise escape and increase the brightness of the display. It may be part of the display substrate not shown in FIG. 5.

Magnesium oxide increases the ionization level through secondary electron emission that in turn leads to reduced gas discharge voltages. The magnesium oxide layer 32 on the inner surface 30-2 of the Plasma-sphere 30 is separate from the phosphor which is located on external surface 30-1 of the Plasma-sphere 30. The thickness of the magnesium oxide may range from about 250 Angstrom Units to 10,000 Angstrom Units (Å).

Magnesium oxide is susceptible to contamination. To avoid contamination, gas discharge (plasma) displays are assembled in clean rooms that are expensive to construct and maintain. In traditional plasma panel production, magnesium oxide is typically applied to an entire substrate surface and is vulnerable to contamination. In FIG. 5 the magnesium oxide layer 32 is on the inside surface 30-2 of the Plasma-sphere 30 and exposure of the magnesium oxide to contamination is minimized.

The magnesium oxide layer 32 may be applied to the inside of the Plasma-sphere 30-2 or other Plasma-shell by incorporating magnesium vapor as part of the ionizable gases introduced into the Plasma-sphere. In some embodiments, the magnesium oxide may be present as particles in the gas. Other secondary electron materials may be used in place of or in combination with magnesium oxide. In one embodiment hereof, the secondary electron material is introduced into the gas by means of a fluidized bed.

In one embodiment, the inside of the Plasma-shell contains a secondary electron emitter. Secondary electron emitters lower the breakdown voltage of the gas and provide a more efficient discharge. Plasma displays traditionally use magnesium oxide for this purpose, although other materials may be used including other Group IIA oxides, rare earth oxides, lead oxides, aluminum oxides, and other materials. It may also be beneficial to add luminescent substances such as phosphor to the inside or outside of the shell.

In one embodiment and mode hereof, the Plasma-shell comprises a metal or metalloid oxide and is filled with an ionizable gas of 99.99% atoms of neon and 0.01% atoms of argon or xenon for use in a monochrome PDP. Examples of shell materials are disclosed herein and include silica, aluminum oxides, zirconium oxides, and magnesium oxides.

In another embodiment, the Plasma-shell contains luminescent substances such as phosphors selected to provide different visible colors including red, blue, and green for use in a full color PDP. The metal or metalloid oxides are typically selected to be highly transmissive to photons produced by the gas discharge especially in the UV range.

In one embodiment, the ionizable gas is selected from any of several known combinations that produce UV light including pure helium, helium with up to 1% atoms neon, helium with up to 1% atoms of argon and up to 15% atoms nitrogen, and neon with up to 15% atoms of xenon or argon. For a multicolor PDP, red, blue, and/or green light-emitting luminescent substance may be applied to the interior or exterior of the shell. The exterior application may comprise a slurry or tumbling process with curing, typically at low temperatures. Infrared curing can also be used. The luminescent substance may be applied by other methods or processes including spraying, ink jet, and so forth. The luminescent substance may be applied externally before or after the Plasma-shell is attached to the PDP substrate. As discussed hereinafter, the luminescent substance may be organic and/or inorganic.

Plasma-Disc

By flattening a Plasma-shell on one or both sides some advantage is gained in mounting the shell to the substrate and connecting the shell to electrical contacts. A Plasma-shell with two substantially flattened opposite sides, i.e., top and bottom, is called a Plasma-disc. This flattening of the Plasma-shell may be done at any suitable temperature, for example, when the shell is at an ambient temperature or at an elevated softening temperature below the melting temperature. The flat viewing surface in a Plasma-disc increases the overall luminous efficiency of a PDP.

Figure 6A:
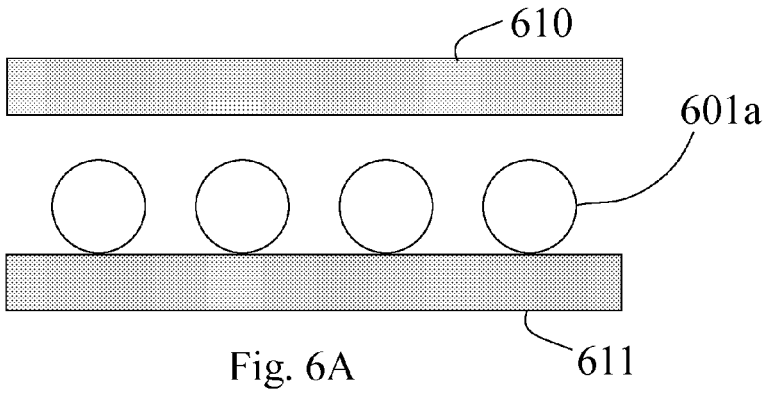
FIGS. 6A, 6B and 6C show process steps for making Plasma-discs.
Figure 6B:
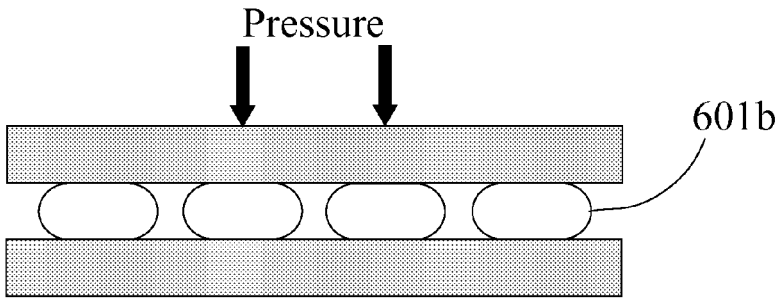
Figure 6C:
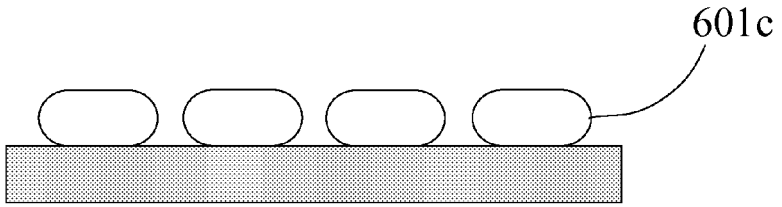

Plasma-discs may be produced while the Plasma-shell is at an elevated temperature below its melting point. As shown in FIGS. 6A, 6B, and 6C, a sufficient pressure or force is applied with member 610 to flatten the shell 601*a* between members 610 and 611 into disc shapes with flat top and bottom. FIG. 6B shows uniform pressure applied to the Plasma-shell to form a flatten Plasma-disc 601*b*. Heat can be applied during the flattening process such as by heating members 610 and 611. FIG. 6C shows the resultant flat Plasma-disc 601*c*. One or more luminescent materials can be applied to the Plasma-Disc before or after positioning on the PDP substrate. Like a coin that can only land "heads" or "tails", a Plasma-disc with a flat top and flat bottom may be applied to a substrate in one of two positions. The cores may also be flattened with heat and/or pressure so as to start the process with preformed discs.

Plasma-Dome

Figure 7A:
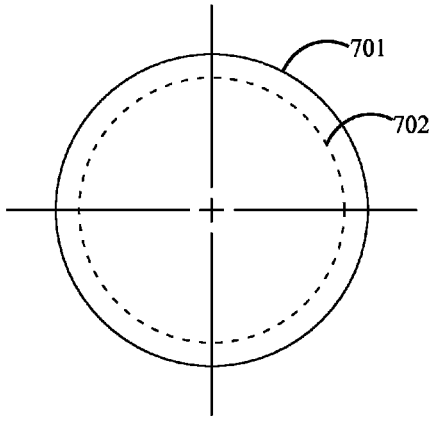
FIGS. 7A, 7B, and 7C show a Plasma-dome with one flat side.
Figure 7B:
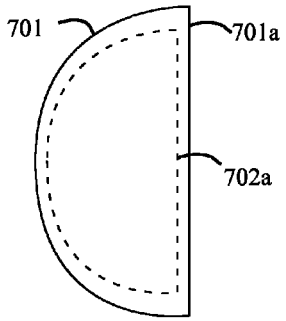
Figure 7C:
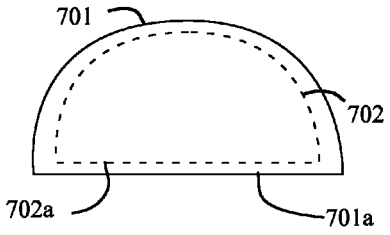

FIG. 7A is a top view of a Plasma-dome showing an outer shell wall 701 and an inner shell wall 702. FIG. 7B is a right side view of FIG. 7A showing a flattened outer wall 701*a* and flattened inner wall 702*a*. FIG. 7C is an alternate side view of FIG. 7A.

Figure 8A:
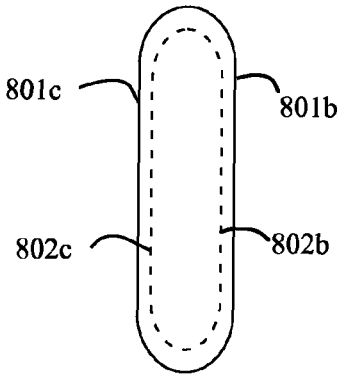
FIGS. 8A, 8B, and 8C show a Plasma-dome with multiple flat sides.
Figure 8B:
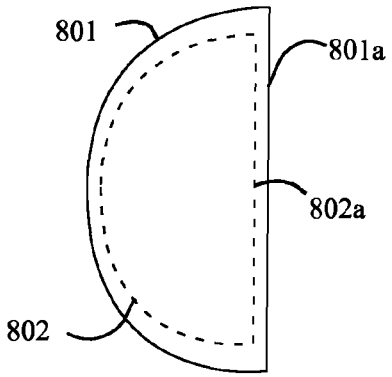
Figure 8C:
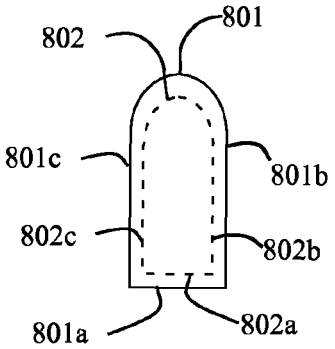

FIG. 8A is a top view of a Plasma-dome with flattened inner shell walls 802*b* and 802*c* and flattened outer shell wall 801*b* and 801*c*. FIG. 8B is a right side view of FIG. 8A showing flattened outer wall 801*a* and flattened inner wall 802*a* with a dome having outer wall 801 and inner wall 802. FIG. 8C is a bottom view of FIG. 8A. One or more sides of a Plasma-dome may be flattened with heat and pressure as shown in FIGS. 6A, 6B, and 6C. In forming the PDP, the dome portion may be positioned into the substrate with the flat side up in the viewing direction.

Figure 9A:
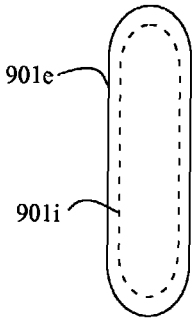
FIGS. 9A and 9B show a Plasma-disc.
Figure 9B:
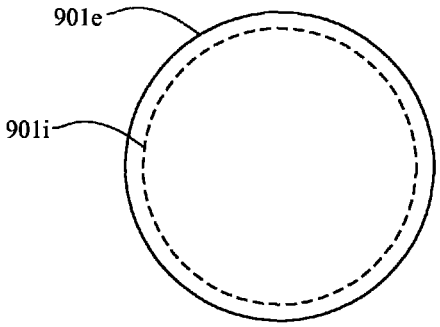

FIGS. 9A and 9B show a Plasma-disc with opposite flat sides and inner surface 901*i* and exterior surface of 901*e*. FIG. 9A is a view of all sides of FIG. 9B.

The geometric shape of the Plasma-shells may be determined by preforming the core into the desired geometric shape. This preforming may be done using heat and/or pressure methods similar to that shown in FIGS. 6A, 6B, and 6C. The cores may be shaped while at ambient or elevated temperatures. A core side may be flattened by selectively applying sufficient heat.

In one embodiment of this invention, the Plasma-shell is used as the pixel element of a single substrate PDP device as shown in FIG. 10. In FIG. 10 the Plasma-shell may be a Plasma-disc, Plasma-sphere, or Plasma-dome. For the assembly of multiple PDP cells or pixels, it is contemplated using Plasma-domes alone or in combination with other Plasma-shells. The shell 1001 is positioned in a well or cavity on a PDP substrate 1002 and is composed of a material selected to have the properties of transmissivity too light, while being sufficiently impermeable as to the confined ionizable gas 1013. The gas 1013 is selected so as to discharge and produce light in the visible or UV range when a voltage is applied to electrodes 1004 and 1003. In the case where the discharge of the ionizable gas produces UV, a UV excitable phosphor (not shown) may be applied to the exterior or interior of the Plasma-shell 1001 or embedded within the shell to produce light. Besides phosphors, other coatings may be applied to the interior and exterior of the shell to enhance contrast, and/or to decrease operating voltage. One such coating contemplated in the practice of this invention is a secondary electron emitter material such as magnesium oxide. Magnesium oxide is used in a PDP to decrease the voltages.

Figure 11A:
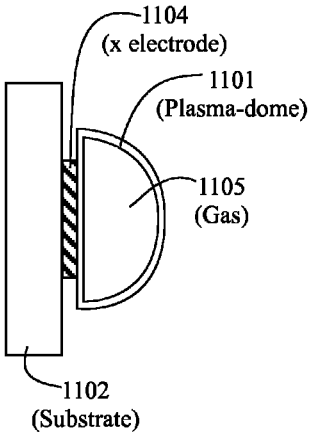
FIGS. 11, 11A, and 11B show a Plasma-dome positioned on the surface of a PDP substrate.
Figure 11:
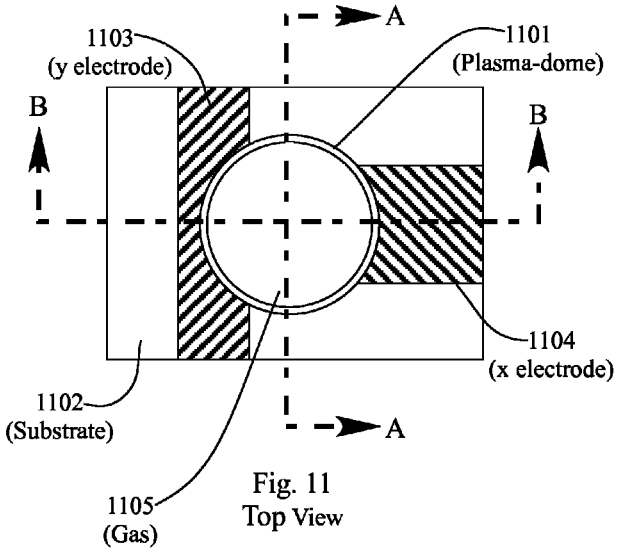
Figure 11B:
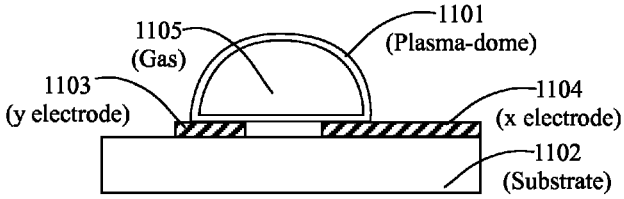

FIGS. 11, 11A, and 11B show a Plasma-dome 1101 filled with gas 1105 positioned on the surface of substrate 1102 with y electrode 1103 and x electrode 1104. FIGS. 11A and 11B are section views of the top view shown in FIG. 11.

As shown in FIG. 11, the Plasma-dome 1101 has a circular geometric shape. As shown in FIGS. 11A and 11B, the circular Plasma-dome 1101 is flat on the bottom.

Figure 12A:
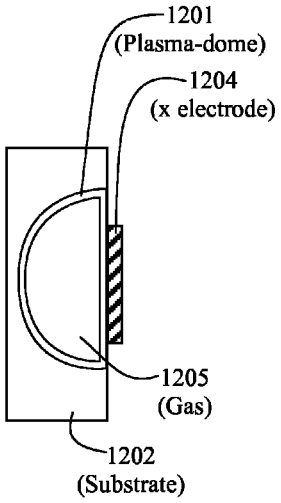
FIGS. 12, 12A, and 12B show a Plasma-dome positioned within a PDP substrate.
Figure 12:
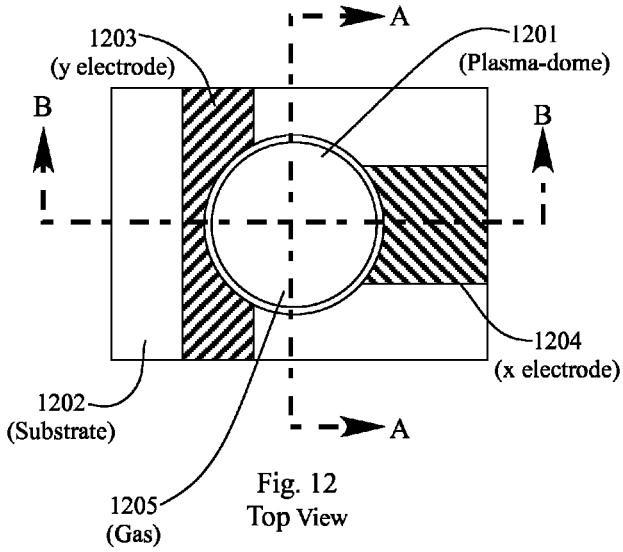
Figure 12B:
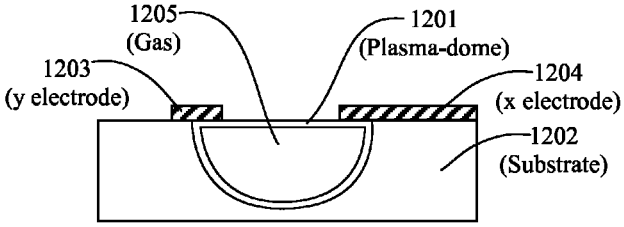

FIGS. 12, 12A, and 12B show a Plasma-dome 1201 filled with gas 1205 positioned within the substrate 1202. There is shown y electrodes 1203 and x electrodes 1204. FIGS. 12A and 12B are section views of the top view shown in FIG. 12.

As shown in FIG. 12, the Plasma-dome 1201 has a circular geometric shape. As shown in FIGS. 12A and 12B, the circular Plasma-dome 1201 is flat on the top and the dome is positioned within the substrate. The flat side is facing up in the viewing direction.

Figure 13A:
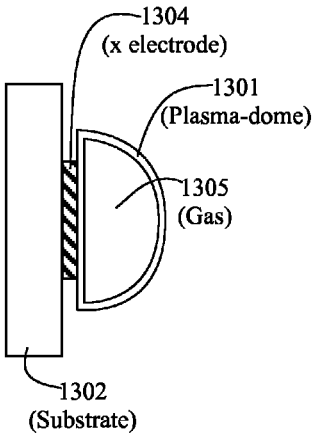
FIGS. 13, 13A, and 13B show an elongated Plasma-dome positioned on the surface of a PDP substrate.
Figure 13:
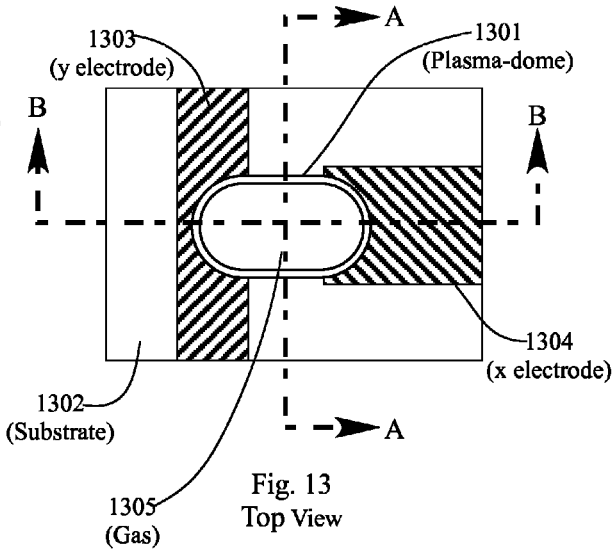
Figure 13B:
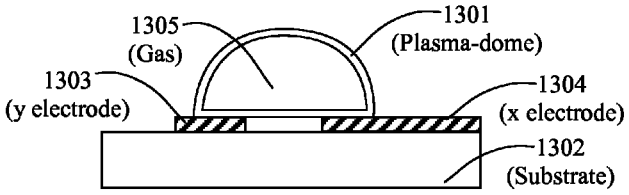

FIGS. 13, 13A, and 13B show a Plasma-dome 1301 filled with gas 1305 positioned on the surface of substrate 1302 with y electrodes 1303 and x electrodes 1304. FIGS. 13A and 13B are section views of the top view shown in FIG. 13. As shown in FIG. 13, the Plasma-dome 1301 is elongated with opposing flat sides. As shown in FIGS. 13A and 13B, the Plasma-dome 1301 is flat on the bottom and sides with a top dome in the viewing direction.

FIGS. 10, 11, 12, and 13 illustrate only one Plasma-shell or Plasma-dome and represent a single cell, sub-cell, pixel, or sub-pixel in a PDP. Adhesive materials, luminescent materials, and electron emission materials are not shown, but may be added, for example as shown in FIG. 5.

PDP Electronics

Figure 14:
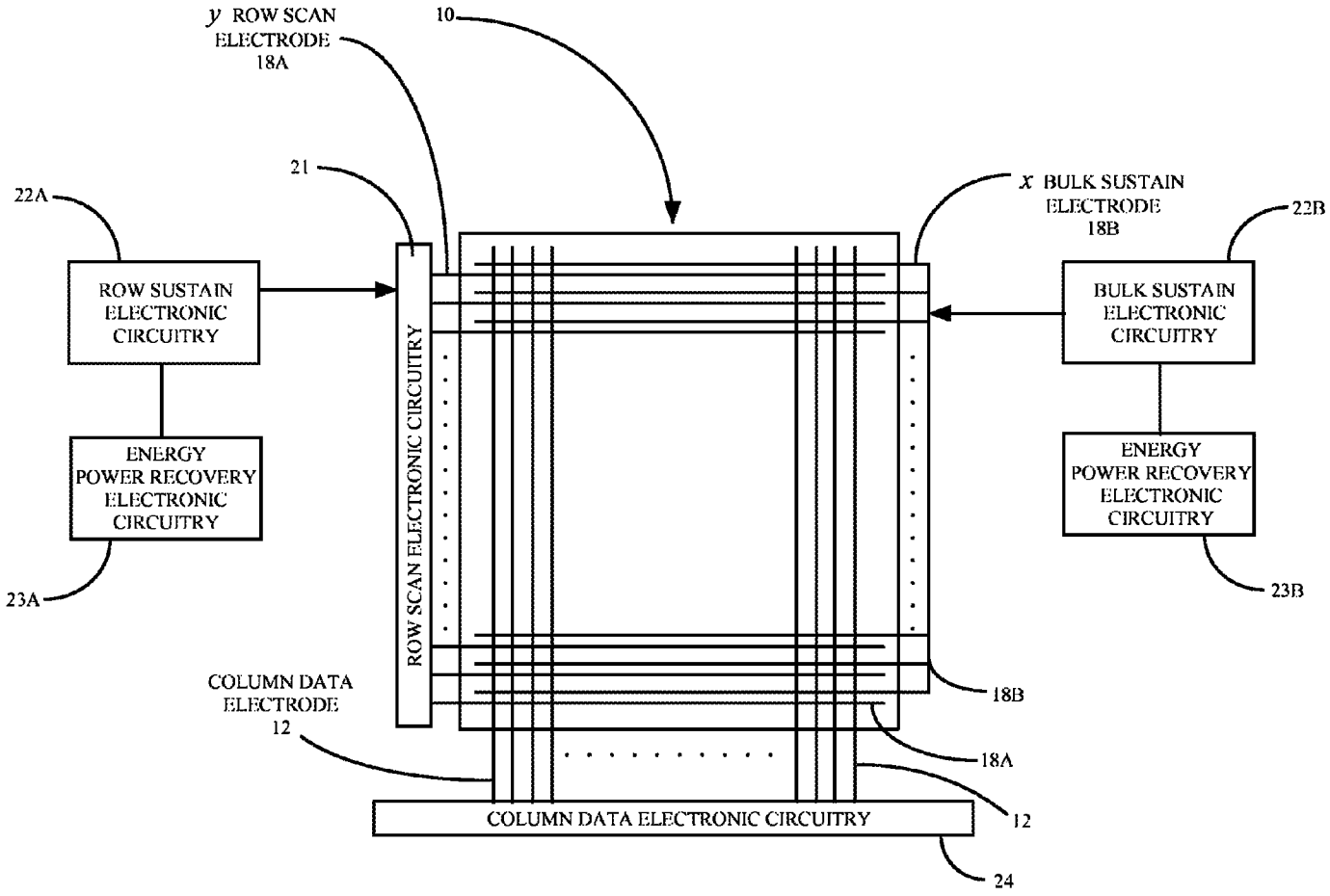
FIG. 14 shows a block diagram of electronics for driving an AC gas discharge plasma display with Plasma-shells as pixels.

FIG. 14 is a block diagram of a plasma display panel (PDP) 10 with electronic circuitry 21 for y row scan electrodes 18A, bulk sustain electronic circuitry 22B for x bulk sustain electrode 18B and column data electronic circuitry 24 for the column data electrodes 12. The pixels or sub-pixels of the PDP comprise Plasma-shells not shown in FIG. 14.

There is also shown row sustain electronic circuitry 22A with an energy power recovery electronic circuit 23A. There is also shown energy power recovery electronic circuitry 23B for the bulk sustain electronic circuitry 22B.

The electronics architecture used in FIG. 14 is ADS as described in the Shinoda and other patents cited herein including U.S. Pat. No. 5,661,500 (Shinoda et al.). In addition, other architectures as described herein and known in the prior art may be utilized. These architectures including Shinoda ADS may be used to address Plasma-shells, including Plasma-spheres, Plasma-discs, or Plasma-domes in a PDP.

ADS

A basic electronics architecture for addressing and sustaining a surface discharge AC plasma display is called Address Display Separately (ADS). The ADS architecture may be used for a monochrome or multicolor display. The ADS architecture is disclosed in a number of Fujitsu patents including U.S. Pat. Nos. 5,541,618 (Shinoda) and 5,724,054 (Shinoda), incorporated herein by reference. Also see U.S. Pat. No. 5,446,344 (Kanazawa) and 5,661,500 (Shinoda et al.), incorporated herein by reference. ADS have become a basic electronic architecture widely used in the AC plasma display industry for the manufacture of PDP monitors and television.

Fujitsu ADS architecture is commercially used by Fujitsu and is also widely used by competing manufacturers including Matsushita and others. ADS is disclosed in U.S. Pat. No. 5,745,086 (Weber), incorporated herein by reference. See FIGS. 2, 3, 11 of Weber '086. The ADS method of addressing and sustaining a surface discharge display as disclosed in U.S. Pat. Nos. 5,541,618 (Shinoda) and 5,724,054 (Shinoda) incorporated herein by reference, sustains the entire panel (all rows) after the addressing of the entire panel. The addressing and sustaining are done separately and are not done simultaneously. ADS may be used to address Plasma-shells including Plasma-spheres, Plasma-discs, or Plasma-domes in a PDP.

ALIS

This invention may also use the so-called shared electrode or electronic ALIS drive system disclosed by Fujitsu in U.S. Pat. Nos. 6,489,939 (Asso et al.), 6,498,593 (Fujimoto et al.), 6,531,819 (Nakahara et al.), 6,559,814 (Kanazawa et al.), 6,577,062 (Itokawa et al.), 6,603,446 (Kanazawa et al.), 6,630,790 (Kanazawa et al.), 6,636,188 (Kanazawa et al.), 6,667,579 (Kanazawa et al.), 6,667,728 (Kanazawa et al.), 6,703,792 (Kawada et al.), and U.S. Patent Application Publication 2004/0046509 (Sakita), all of which are incorporated herein by reference. ALIS may be used to address Plasma-shells including Plasma-spheres, Plasma-discs, and Plasma-domes in a PDP.

AWD

Figure 3:
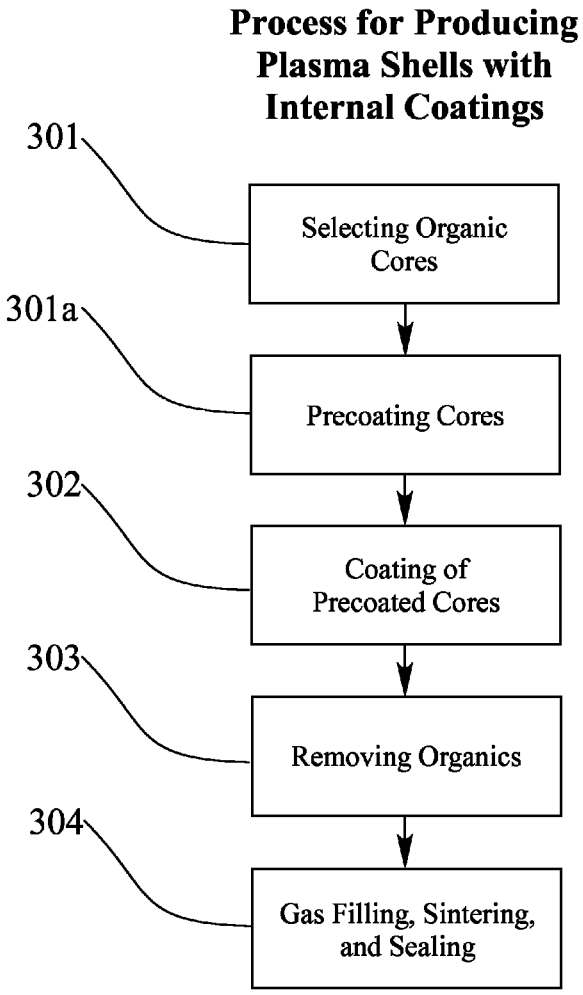
FIG. 3 is a block diagram of a process for producing a Plasma-shell with internal coatings.

Another electronic architecture is called Address While Display (AWD). The AWD electronics architecture was first used during the 1970s and 1980s for addressing and sustaining monochrome PDP. In AWD architecture, the addressing (write and/or erase pulses) are interspersed with the sustain waveform and may include the incorporation of address pulses onto the sustain waveform. Such address pulses may be on top of the sustain and/or on a sustain notch or pedestal. See for example U.S. Pat. Nos. 3,801,861 (Petty et al.) and 3,803,449 (Schmersal), both incorporated herein by reference. FIGS. 1 and 3 of the Shinoda '054 ADS patent discloses AWD architecture as prior art.

The AWD electronics architecture for addressing and sustaining monochrome PDP has also been adopted for addressing and sustaining multi-color PDP. For example, Samsung Display Devices Co., Ltd., has disclosed AWD and the superimpose of address pulses with the sustain pulse. Samsung specifically labels this as address while display (AWD). See "High-Luminance and High-Contrast HDTV PDP with Overlapping Driving Scheme", J. Ryeom et al., pages 743 to 746, *Proceedings of the Sixth International Display Workshops*, IDW 99, Dec. 1-3, 1999, Sendai, Japan and AWD as disclosed in U.S. Pat. No. 6,208,081 (Eo et al.), incorporated herein by reference.

LG Electronics Inc. has disclosed a variation of AWD with a Multiple Addressing in a Single Sustain (MASS) in U.S. Pat. No. 6,198,476 (Hong et al.), incorporated herein by reference. Also see U.S. Pat. No. 5,914,563 (Lee et al.), incorporated herein by reference. AWD may be used to address Plasma-shells including Plasma-spheres, Plasma-discs, and Plasma-domes in a PDP.

An AC voltage refresh technique or architecture is disclosed by U.S. Pat. No. 3,958,151 (Yano et al.), incorporated herein by reference. In one embodiment of this invention the Plasma-shells are filled with pure neon and operated with the architecture of Yano et al. '151.

Energy Recovery

Energy recovery is used for the efficient operation of a PDP. Examples of energy recovery architecture and circuits are well known in the prior art. These include U.S. Pat. Nos. 4,772,884 (Weber et al.) 4,866,349 (Weber et al.), 5,081,400 (Weber et al.), 5,438,290 (Tanaka), 5,642,018 (Marcotte), 5,670,974 (Ohba et al.), 5,808,420 (Rilly et al.) and 5,828,353 (Kishi et al.), all incorporated herein by reference.

Slow Ramp Reset

Slow rise slopes or ramps may be used in the practice of this invention. The prior art discloses slow rise slopes or ramps for the addressing of AC plasma displays. The early patents include U.S. Pat. Nos. 4,063,131 (Miller) and 4,087,805 (Miller), 4,087,807 (Miavecz), 4,611,203 (Criscimagna et al.) and 4,683,470 (Criscimagna et al.), all incorporated herein by reference.

An architecture for a slow ramp reset voltage is disclosed in U.S. Pat. No. 5,745,086 (Weber), incorporated herein by reference. Weber '086 discloses positive or negative ramp voltages that exhibit a slope that is set to assure that current flow through each display pixel site remains in a positive resistance region of the gas's discharge characteristics. The slow ramp architecture may be used in combination with ADS as disclosed in FIG. 11 of Weber '086. PCT Patent Application WO 00/30065 filed by (Hibino et al.) also discloses architecture for a slow ramp reset voltage and is incorporated herein by reference.

Artifact Reduction

Artifact reduction techniques may be used in the practice of this invention. The PDP industry has used various techniques to reduce motion and visual artifacts in a PDP display. Pioneer of Tokyo, Japan has disclosed a technique called CLEAR for the reduction of false contour and related problems. See "Development of New Driving Method for AC-PDPs" by Tokunaga et al. of Pioneer, *Proceedings of the Sixth International Display Workshops*, IDW 99, pages 787-790, Dec. 1-3, 1999, Sendai, Japan. Also see European Patent Application EP 1020838 A1 by Tokunaga et al. of Pioneer.

The CLEAR techniques disclosed in the above Pioneer IDW publication and Pioneer EP 1020838 A1, are incorporated herein by reference.

In the practice of this invention, it is contemplated that the ADS architecture may be combined with a CLEAR or like technique as required for the reduction of motion and visual artifacts. The CLEAR and ADS may also be used with the slope ramp address.

SAS

In one embodiment of this invention it is contemplated using SAS electronic architecture to address a PDP panel constructed of Plasma-shells, Plasma-discs, and/or Plasma-domes. SAS architecture comprises addressing one display section of a surface discharge PDP while another section of the PDP is being simultaneously sustained. This architecture is called Simultaneous Address and Sustain (SAS). See U.S. Patent Application Publication 2001/0038366, incorporated herein by reference.

SAS offers a unique electronic architecture which is different from prior art columnar discharge and surface discharge electronics architectures including ADS, AWD, and MASS. It offers important advantages as discussed herein.

In accordance with the practice of SAS with a surface discharge PDP, addressing voltage waveforms are applied to a surface discharge PDP having an array of data electrodes on a bottom or rear substrate and an array of at least two electrodes on a top or front viewing substrate, one top electrode being a bulk sustain electrode x and the other top electrode being a row scan electrode y. The row scan electrode y may also be called a row sustain electrode because it performs the dual functions of both addressing and sustaining.

An important feature and advantage of SAS is that it allows selectively addressing of one section of a surface discharge PDP with selective write and/or selective erase voltages while another section of the panel is being simultaneously sustained. A section is defined as a predetermined number of bulk sustain electrodes x and row scan electrodes y. In a surface discharge PDP, a single row is comprised of one pair of parallel top electrodes x and y.

In one embodiment of SAS, there is provided the simultaneous addressing and sustaining of at least two sections $S_1$ and $S_2$ of a surface discharge PDP having a row scan, bulk sustain, and data electrodes, which comprises addressing one section $S_1$ of the PDP while a sustaining voltage is being simultaneously applied to at least one other section $S_2$ of the PDP.

In another embodiment, the simultaneous addressing and sustaining is interlaced whereby one pair of electrodes y and x are addressed without being sustained and an adjacent pair of electrodes y and x are simultaneously sustained without being addressed. This interlacing can be repeated throughout the display. In this embodiment, a section S is defined as one or more pairs of interlaced y and x electrodes.

In the practice of SAS, the row scan and bulk sustain electrodes of one section that is being sustained may have a reference voltage which is offset from the voltages applied to the data electrodes for the addressing of another section such that the addressing does not electrically interact with the row scan and bulk sustain electrodes of the section which is being sustained.

In a plasma display in which gray scale is realized through time multiplexing, a frame or a field of picture data is divided into subfields. Each subfield is typically composed of a reset period, an addressing period, and a number of sustains. The number of sustains in a subfield corresponds to a specific gray scale weight. Pixels that are selected to be "on" in a given subfield will be illuminated proportionally to the number of sustains in the subfield. In the course of one frame, pixels may be selected to be "on" or "off" for the various subfields. A gray scale image is realized by integrating in time the various "on" and "off" pixels of each of the subfields.

Addressing is the selective application of data to individual pixels. It includes the writing or erasing of individual pixels.

Reset is a voltage pulse which forms wall charges to enhance the addressing of a pixel. It can be of various waveform shapes and voltage amplitudes including fast or slow rise time voltage ramps and exponential voltage pulses. A reset is typically used at the start of a frame before the addressing of a section. A reset may also be used before the addressing period of a subsequent subfield.

In accordance with a another embodiment of the SAS architecture, there is applied a slow rise time or slow ramp reset voltage as disclosed in U.S. Pat. No. 5,745,086 (Weber) cited above and incorporated herein by reference. As used herein "slow rise time or slow ramp voltage" is a bulk address commonly called a reset pulse with a positive or negative slope so as to provide a uniform wall charge at all pixels in the PDP.

The slower the rise time of the reset ramp, the less visible the light or background glow from those off-pixels (not in the on-state) during the slow ramp bulk address.

Less background glow is particularly desirable for increasing the contrast ratio which is inversely proportional to the light-output from the off pixels during the reset pulse. Those off-pixels which are not in the on-state will give a background glow during the reset. The slower the ramp, the less light output with a resulting higher contrast ratio. Typically the "slow ramp reset voltages" disclosed in the prior art have a slope of about 3.5 volts per microsecond with a range of about 2 to about 9 volts per microsecond. In the SAS architecture, it is possible to use "slow ramp reset voltages" below 2 volts per microsecond, for example about 1 to 1.5 volts per microsecond without decreasing the number of PDP rows, without decreasing the number of sustain pulses or without decreasing the number of subfields.

Positive Column Gas Discharge

In one embodiment of this invention, it is contemplated that the PDP may be operating using positive column gas discharge. The following prior art references relate to positive column gas discharge and are incorporated herein by reference.

U.S. Pat. No. 6,184,848 (Weber) discloses the generation of a positive column plasma discharge wherein the plasma discharge evidences a balance of positively charged ions and electrons. The PDP discharge operates using the same fundamental principle as a fluorescent lamp, i.e., a PDP employs ultraviolet light generated by a gas discharge to excite visible light-emitting phosphors. Weber discloses an inactive isolation bar.

"PDP With Improved Drive Performance at Reduced Cost" by James Rutherford, Huntertown, Ind., *Proceedings of the Ninth International Display Workshops*, Hiroshima, Japan, pages 837 to 840, Dec. 4-6, 2002, discloses an electrode structure and electronics for a positive column plasma display. Rutherford discloses the use of the isolation bar as an active electrode.

Additional positive column gas discharge prior art includes: "Positive Column AC Plasma Display", Larry F. Weber, 23rd International Display Research Conference (IDRC 03), September 16-18, *Conference Proceedings*, pages 119-124, Phoenix, Ariz.

"Dielectric Properties and Efficiency of Positive Column AC PDP", Nagorny et al., 23rd International Display Research Conference (IDRC 03), Sep. 16-18, 2003, *Conference Proceedings*, P-45, pages 300-303, Phoenix, Ariz.

Simulations of AC PDP Positive Column and Cathode Fall Efficiencies", Drallos et al., 23rd International Display Research Conference (IDRC 03), Sep. 16-18, 2003, *Conference Proceedings*, P-48, pages 304-306, Phoenix, Ariz.

The use of Plasma-shells, including Plasma-spheres, Plasma-discs, and Plasma-domes allow the PDP to be operated with positive column gas discharge, for example as disclosed by Weber, Rutherford, and other prior art cited hereinafter and incorporated herein by reference. The discharge length inside the Plasma-shell must be sufficient to accommodate the length of the Positive Column Gas discharge, generally up to about 1400 micrometers.

Shell Materials

The Plasma-shell may be constructed of any suitable material. In the practice of this invention, it is contemplated that the Plasma-shell may be made of inorganic compounds of metals and/or metalloids, including mixtures or combinations thereof. The contemplated inorganic compounds include the oxides, carbides, nitrides, nitrates, silicates, silicides, aluminates, phosphates, borides, and/or borates.

The metals and/or metalloids are selected from magnesium, calcium, strontium, barium, yttrium, lanthanum, cerium, neodymium, gadolinium, terbium, erbium, thorium, titanium, zirconium, hafnium, vanadium, niobium, tantalum, chromium, molybdenum, tungsten, manganese, rhenium, iron, ruthenium, osmium, cobalt, rhodium, iridium, nickel, copper, silver, zinc, cadmium, boron, aluminum, gallium, indium, thallium, carbon, silicon, germanium, tin, lead, phosphorus, and bismuth.

Inorganic materials suitable for use are magnesium oxide(s), aluminum oxide(s), zirconium oxide(s), and silicon carbide(s) such as MgO, $Al_2O_3$, $ZrO_2$, $SiO_2$, and/or SiC.

In one embodiment of this invention, the Plasma-shell is made of fused particles of glass, ceramic, glass ceramic, refractory, fused silica, quartz, or like amorphous and/or crystalline materials including mixtures of such.

In one preferred embodiment, a ceramic material is selected based on its transmissivity to light after firing. This may include selecting ceramics material with various optical cutoff frequencies to produce various colors. One preferred material contemplated for this application is aluminum oxide. Aluminum oxide is transmissive from the UV range to the IR range. Because it is transmissive in the UV range, phosphors excited by UV may be applied to the exterior of the Plasma-shell to produce various colors. The application of the phosphor to the exterior of the Plasma-shell may be done by any suitable means before or after the Plasma-shell is positioned in the PDP, i.e., on a flexible or rigid substrate. There may be applied several layers or coatings of phosphors, each of a different composition.

In one specific embodiment of this invention, the Plasma-shell is made of an aluminate silicate or contains a layer of aluminate silicate. When the ionizable gas mixture contains helium, the aluminate silicate is especially beneficial in preventing the escaping of helium.

It is also contemplated that the Plasma-shell may be made of lead silicates, lead phosphates, lead oxides, borosilicates, alkali silicates, aluminum oxides, and pure vitreous silica.

For secondary electron emission, the Plasma-shell may be made in whole or in part from one or more materials such as magnesium oxide having a sufficient Townsend coefficient. These include inorganic compounds of magnesium, calcium, strontium, barium, gallium, lead, aluminum, boron, and the rare earths especially lanthanum, cerium, actinium, and thorium. The contemplated inorganic compounds include oxides, carbides, nitrides, nitrates, silicates, aluminates, phosphates, borates, and other inorganic compounds of the above and other elements.

The Plasma-shell may also contain or be partially or wholly constructed of luminescent materials such as inorganic phosphor(s). The phosphor may be a continuous or discontinuous layer or coating on the interior or exterior of the shell. Phosphor particles may also be introduced inside the Plasma-shell or embedded within the shell. Luminescent quantum dots may also be incorporated into the shell.

Secondary Electron Emission

The use of secondary electron emission (Townsend coefficient) materials in a plasma display is well known in the prior art and is disclosed in U.S. Pat. No. 3,716,742 (Nakayama et al.) The use of Group IIA compounds including magnesium oxide is disclosed in U.S. Pat. Nos. 3,836,393 and 3,846,171. The use of rare earth compounds in an AC plasma display is disclosed in U.S. Pat. Nos. 4,126,807 (Wedding et al.), 4,126,809 (Wedding et al.), and 4,494,038 (Wedding et al.), incorporated herein by reference. Lead oxide may also be used as a secondary electron material.

In one embodiment and mode contemplated for the practice of this invention, the secondary electron emission material is magnesium oxide on part or all of the internal surface of a Plasma-shell. The secondary electron emission material may also be on the external surface. The thickness of the magnesium oxide may range from about 250 Angstrom Units to about 10,000 Angstrom Units (Å).

The entire Plasma-shell may be made of a secondary electronic material such as magnesium oxide. A secondary electron material may also be dispersed or suspended as particles within the ionizable gas such as with a fluidized bed. Phosphor particles may also be dispersed or suspended in the gas such as with a fluidized bed, and may also be added to the inner or external surface of the Plasma-shell.

Magnesium oxide increases the ionization level through secondary electron emission that in turn leads to reduced gas discharge voltages. In one embodiment, the magnesium oxide is on the inner surface of the Plasma-shell and the phosphor is located on external surface of the Plasma-shell.

Magnesium oxide is susceptible to contamination. To avoid contamination, gas discharge (plasma) displays are assembled in clean rooms that are expensive to construct and maintain. In traditional plasma panel production, magnesium oxide is applied to an entire open substrate surface and is vulnerable to contamination. The adding of the magnesium oxide layer to the inside of a Plasma-shell minimizes exposure of the magnesium oxide to contamination.

The magnesium oxide may be applied to the inside of the Plasma-shell by incorporating magnesium vapor as part of the ionizable gases introduced into the Plasma-shell while the microsphere is at an elevated temperature. The magnesium may be oxidized while at an elevated temperature.

In some embodiments, the magnesium oxide may be added as particles to the gas. Other secondary electron materials may be used in place of or in combination with magnesium oxide. In one embodiment hereof, the secondary electron material such as magnesium oxide or any other selected material such as magnesium to be oxidized in situ is introduced into the gas by means of a fluidized bed. Other materials such as phosphor particles or vapor may also be introduced into the gas with a fluid bed or other means.

Ionizable Gas

The hollow Plasma-shell as used in the practice of this invention contain(s) one or more ionizable gas components. As used herein, ionizable gas or gas means one or more gas components. In the practice of this invention, the gas is typically selected from a mixture of the rare gases of neon, argon, xenon, krypton, helium, and/or radon. The rare gas may be a Penning gas mixture. Other contemplated gases include nitrogen, $CO_2$, mercury, halogens, excimers, oxygen, hydrogen, deuterium, tritium ($T^3$), and DT.

In one embodiment, a two-component gas mixture (or composition) is used such as a mixture of argon and xenon, argon and helium, xenon and helium, neon and argon, neon and xenon, neon and helium, and neon and krypton.

Specific two-component gas mixtures (compositions) include about 5% to 90% atoms of argon with the balance xenon.

Another two-component gas mixture is a mother gas of neon containing 0.05% to 15% atoms of xenon, argon, or krypton. This can also be a three-component, four-component gas, or five-component gas by using small quantities of an additional gas or gases selected from xenon, argon, krypton, and/or helium.

In another embodiment, a three-component ionizable gas mixture is used such as a mixture of argon, xenon, and neon wherein the mixture contains at least 5% to 80% atoms of argon, up to 15% xenon, and the balance neon. The xenon is present in a minimum amount sufficient to maintain the Penning effect. Such a mixture is disclosed in U.S. Pat. No. 4,926,095 (Shinoda et al.), incorporated herein by reference. Other three-component gas mixtures include argon-helium-xenon; krypton-neon-xenon; and krypton-helium-xenon.

U.S. Pat. No. 4,081,712 (Bode et al.), incorporated herein by reference, discloses the addition of helium to a gaseous medium of 90% to 99.99% atoms of neon and 10% to 0.01% atoms of argon, xenon, and/or krypton.

In one embodiment there is used a high concentration of helium with the balance selected from one or more gases of neon, argon, xenon, and nitrogen as disclosed in U.S. Pat. No. 6,285,129 (Park) and incorporated herein by reference.

A high concentration of xenon may also be used with one or more other gases as disclosed in U.S. Pat. No. 5,770,921 (Aoki et al.), incorporated herein by reference.

Pure neon may be used and the Plasma-shells operated without memory margin using the architecture disclosed by U.S. Pat. No. 3,958,151 (Yano et al.) discussed above and incorporated herein by reference.

Excimers

Excimer gases may also be used as disclosed in U.S. Pat. Nos. 4,549,109 (Nighan et al.) and 4,703,229 (Nighan et al.), both incorporated herein by reference. Nighan et al. '109 and '229 disclose the use of excimer gases formed by the combination of halides with inert gases. The halides include fluorine, chlorine, bromine, and iodine. The inert gases include helium, xenon, argon, neon, krypton, and radon. Excimer gases may emit red, blue, green, or other color light in the visible range or light in the invisible range. The excimer gases may be used alone or in combination with phosphors.

Gas Pressure

This invention allows the construction and operation of a gas discharge (plasma) display with gas pressures at or above 1 atmosphere. In the prior art, gas discharge (plasma) displays are operated with the ionizable gas at a pressure below atmospheric. Gas pressures above atmospheric are not used in the prior art because of structural problems. Higher gas pressures above atmospheric may cause the display substrates to separate, especially at elevations of 4000 feet or more above sea level. Such separation may also occur between the substrate and a viewing envelope or dome in a single substrate or monolithic plasma panel structure.

In the practice of this invention, the gas pressure inside of the hollow Plasma-shell may be equal to or less than atmospheric pressure or may be equal to or greater than atmospheric pressure. The typical sub-atmospheric pressure is about 150 to 760 Torr. However, pressures above atmospheric may be used depending upon the structural integrity of the Plasma-shell.

In one embodiment of this invention, the gas pressure inside of the Plasma-shell is equal to or less than atmospheric, about 150 to 760 Torr, typically about 350 to about 650 Torr.

In another embodiment of this invention, the gas pressure inside of the Plasma-shell is equal to or greater than atmospheric. Depending upon the structural strength of the Plasma-shell, the pressure above atmospheric may be about 1 to 250 atmospheres (760 to 190,000 Ton) or greater. Higher gas pressures increase the luminous efficiency of the plasma display.

Gas Processing

This invention avoids the costly prior art gas filling techniques used in the manufacture of gas discharge (plasma) display devices. The prior art introduces gas through one or more apertures into the device requiring a gas injection hole and tube. The prior art manufacture steps typically include heating and baking out the assembled device (before gas fill) at a high-elevated temperature under vacuum for 2 to 12 hours. The vacuum is obtained via external suction through a tube inserted in an aperture.

The bake out is followed by back fill of the entire panel with an ionizable gas introduced through the tube and aperture. The tube is then sealed-off.

This bake out and gas fill process is a major production bottleneck and yield loss in the manufacture of gas discharge (plasma) display devices, requiring substantial capital equipment and a large amount of process time. For color AC plasma display panels of 40 to 50 inches in diameter, the bake out and vacuum cycle may be 10 to 30 hours per panel or 10 to 30 million hours per year for a manufacture facility producing over 1 million plasma display panels per year.

The gas-filled Plasma-shells used in this invention can be produced in large economical volumes and added to the gas discharge (plasma) display device without the necessity of costly bake out and gas process capital equipment. The savings in capital equipment cost and operations costs are substantial. Also the entire PDP does not have to be gas processed with potential yield loss at the end of the PDP manufacture.

PDP Structure

In one embodiment, the Plasma-shells are located on or in a single substrate or monolithic PDP structure. Single substrate PDP structures are disclosed in U.S. Pat. Nos. 3,646,384 (Lay), 3,652,891 (Janning), 3,666,981 (Lay), 3,811,061 (Nakayama et al.), 3,860,846 (Mayer), 3,885,195 (Amano), 3,935,494 (Dick et al.), 3,964,050 (Mayer), 4,106,009 (Dick), 4,164,678 (Biazzo et al.), and 4,638,218 (Shinoda), all cited above and incorporated herein by reference.

The Plasma-shells may also be positioned on or in a substrate within a dual substrate plasma display structure. Each shell is placed inside of a gas discharge (plasma) display device, for example, in a cavity on the substrate along the channels or grooves between the barrier walls of a plasma display barrier structure such as disclosed in U.S. Pat. Nos. 5,661,500 (Shinoda et al.), 5,674,553 (Shinoda et al.), and 5,793,158 (Wedding), cited above and incorporated herein by reference. The Plasma-shells may also be positioned within a cavity, well, hollow, concavity, or saddle of a plasma display substrate, for example as disclosed by U.S. Pat. No. 4,827,186 (Knauer et al.), incorporated herein by reference.

In a device as disclosed by Wedding '158 or Shinoda et al. '500, the Plasma-shells may be conveniently added to the substrate cavities and the space between opposing electrodes before the device is sealed. An aperture and tube can be used for bake out if needed of the space between the two opposing substrates, but the costly gas fill operation is eliminated.

AC plasma displays of 40 to 50 inches are fragile with risk of breakage during shipment and handling. The presence of the Plasma-shells inside of the display device adds structural support and integrity to the device.

The Plasma-shells may be sprayed, stamped, pressed, poured, screen-printed, or otherwise applied to the substrate. The substrate surface may contain an adhesive or sticky surface.

The practice of this invention is not limited to flat surface displays. The Plasma-shell may be positioned or located on a conformal surface or substrate so as to conform to a predetermined shape such as a curved or irregular surface.

In one embodiment of this invention, each Plasma-shell is positioned within a cavity on a single-substrate or monolithic gas discharge structure that has a flexible or bendable substrate. In another embodiment, the substrate is rigid. The substrate may also be partially or semi flexible.

Substrate

In accordance with this invention, the PDP may be comprised of a single substrate or dual substrate device with flexible, semi-flexible, or rigid substrates. The substrate may be opaque, transparent, translucent, or non-light transmitting. In some embodiments, there may be used multiple substrates of three or more. Substrates may be flexible films, such as a polymeric film substrate. Alternatively or in addition, one or both substrates may be made of an optically-transparent thermoplastic polymeric material. Examples of suitable such materials are polycarbonate, polyvinyl chloride, polystyrene, polymethyl methacrylate, polyurethane polyimide, polyester, and cyclic polyolefin polymers. More broadly, the substrates may include a flexible plastic such as a material selected from the group consisting of polyether sulfone (PES), polyethylene terephthalate (PET), polyethylene naphthalate, polycarbonate, polybutylene telephthalate, polyphenylene sulfide (PPS), polypropylene, aramid, polyamide-imide (PAI), polyimide, aromatic polyimides, polyetherimide, acrylonitrile butadiene styrene, and polyvinyl chloride.

Alternatively, one or both of the substrates may be made of a rigid material. For example, one or both of the substrates may be a glass substrate. The glass may be a conventionally-available glass, for example having a thickness of approximately 0.2 mm-1 mm. Alternatively, other suitable transparent materials may be used, such as a rigid plastic or a plastic film. The plastic film may have a high glass transition temperature, for example above 65° C., and may have a transparency greater than 85% at 530 nm.

Further details regarding substrates and substrate materials may be found in International Publications Nos. WO 00/46854, WO 00/49421, WO 00/49658, WO 00/55915, and WO 00/55916, the entire disclosures of which are herein incorporated herein by reference. Apparatus, methods, and compositions for producing flexible substrates are disclosed in U.S. Pat. Nos. 5,469,020 (Herrick), 6,274,508 (Jacobsen et al.), 6,281,038 (Jacobsen et al.), 6,316,278 (Jacobsen et al.), 6,468,638 (Jacobsen et al.), 6,555,408 (Jacobsen et al.), 6,590,346 (Hadley et al.), 6,606,247 (Credelle et al.), 6,665,044 (Jacobsen et al.), and 6,683,663 (Hadley et al.), all of which are incorporated herein by reference.

Locating of Plasma-shell on Substrate

In one embodiment of this invention, the Plasma-shell is bonded to the surface of a monolithic or dual-substrate display such as a PDP. The Plasma-shell is bonded to the substrate surface with a non-conductive, adhesive material which also serves as an insulating barrier to prevent electrically shorting of the conductors or electrodes connected to the Plasma-shell.

The Plasma-shell may be mounted or positioned within a substrate cavity. The cavity is of suitable dimensions with a mean or average diameter and depth for receiving and retaining the Plasma-shell. As used herein cavity includes well, hollow, hole, or similar configuration. In U.S. Pat. No. 4,827,186 (Knauer et al.), there is shown a cavity referred to as a concavity or saddle. The cavity may extend partly through the substrate, embedded within or extend entirely through the substrate.

Insulating Barrier

The insulating barrier may comprise any suitable non-conductive material which bonds the Plasma-shell to the substrate.

In one embodiment, there is used an epoxy resin that is the reaction product of epichlorohydrin and bisphenol-A. One such epoxy resin is a liquid epoxy resin, D.E.R. 383, produced by the Dow Plastics group of the Dow Chemical Company.

Electrically Conductive Bonding Substance

In the practice of this invention, the conductors or electrodes are electrically connected to each Plasma-shell with an electrically conductive bonding substance.

The electrically conductive bonding substance can be any suitable inorganic or organic material including compounds, mixtures, dispersions, pastes, liquids, cements, and adhesives.

In one embodiment, the electrically-conductive bonding substance is an organic substance with conductive filler material.

Contemplated organic substances include adhesive monomers, dimers, trimers, polymers and copolymers of materials such as polyurethanes, polysulfides, silicones, and epoxies. A wide range of other organic or polymeric materials may be used.

Contemplated conductive filler materials include conductive metals or metalloids such as silver, gold, platinum, copper, chromium, nickel, aluminum, and carbon.

The conductive filler may be of any suitable size and form such as particles, powder, agglomerates, or flakes of any suitable size and shape. It is contemplated that the particles, powder, agglomerates, or flakes may comprise a non-metal, metal, or metalloid core with an outer layer, coating, or film of conductive metal.

Some specific embodiments of conductive filler materials include silver-plated copper beads, silver-plated glass beads, silver particles, silver flakes, gold-plated copper beads, gold-plated glass beads, gold particles, gold flakes, and so forth.

In one particular embodiment of this invention there is used an epoxy filled with 60% to 80% by weight silver.

Examples of electrically conductive bonding substances are well known in the art. The disclosures including the compositions of the following references are incorporated herein by reference.

U.S. Pat. No. 3,412,043 (Gilliland) discloses an electrically conductive composition of silver flakes and resinous binder.

U.S. Pat. No. 3,983,075 (Marshall et al.) discloses a copper filled electrically conductive epoxy.

U.S. Pat. No. 4,247,594 (Shea et al.) discloses an electrically conductive resinous composition of copper flakes in a resinous binder.

U.S. Pat. Nos. 4,552,607 (Frey) and 4,670,339 (Frey) disclose a method of forming an electrically conductive bond using copper microspheres in an epoxy.

U.S. Pat. No. 4,880,570 (Sanborn et al.) discloses an electrically conductive epoxy-based adhesive selected from the amine curing modified epoxy family with a filler of silver flakes.

U.S. Pat. No. 5,183,593 (Durand et al.) discloses an electrically conductive cement comprising a polymeric carrier such as a mixture of two epoxy resins and filler particles selected from silver agglomerates, particles, flakes, and powders. The filler may be silver-plated particles such as inorganic spheroids plated with silver. Other noble metals and non-noble metals such as nickel are disclosed.

U.S. Pat. No. 5,298,194 (Carter et al.) discloses an electrically conductive adhesive composition comprising a polymer or copolymer of polyolefins or polyesters filled with silver particles.

U.S. Pat. No. 5,575,956 (Hermansen et al.) discloses electrically-conductive, flexible epoxy adhesives comprising a polymeric mixture of a polyespoxide resin and an epoxy resin filled with conductive metal powder, flakes, or non-metal particles having a metal outer coating. The conductive metal is a noble metal such as gold, silver, or platinum. Silver-plated copper beads and silver-plated glass beads are also disclosed.

U.S. Pat. No. 5,891,367 (Basheer et al.) discloses a conductive epoxy adhesive comprising an epoxy resin cured or reacted with selected primary amines and filled with silver flakes. The primary amines provide improved impact resistance.

U.S. Pat. No. 5,918,364 (Kulesza et al.) discloses substrate bumps or pads formed of electrically conductive polymers filled with gold or silver.

U.S. Pat. No. 6,184,280 (Shibuta) discloses an organic polymer containing hollow carbon microfibres and an electrically conductive metal oxide powder.

In another embodiment, the electrically-conductive bonding substance is an organic substance without a conductive filler material.

Examples of electrically-conductive bonding substances are well known in the art. The disclosures including the compositions of the following references are incorporated herein by reference.

U.S. Pat. No. 5,645,764 (Angelopoulos et al.) discloses electrically conductive pressure sensitive polymers without conductive fillers. Examples of such polymers include electrically conductive substituted and unsubstituted polyanilines, substituted and unsubstituted polyparaphenylenes, substituted and unsubstituted polyparaphenylene vinylenes, substituted and unsubstituted polythiophenes, substituted and unsubstituted polyazines, substituted and unsubstituted polyfuranes, substituted and unsubstituted polypyrroles, substituted and unsubstituted polyselenophenes, substituted and unsubstituted polyphenylene sulfides and substituted and unsubstituted polyacetylenes formed from soluble precursors. Blends of these polymers are suitable for use as are copolymers made from the monomers, dimers, or trimers, used to form these polymers.

Electrically conductive polymer compositions are also disclosed in U.S. Pat. Nos. 5,917,693 (Kono et al.), 6,096,825 (Garnier), and 6,358,438 (Isozaki et al.).

The electrically conductive polymers disclosed above may also be used with conductive fillers.

In some embodiments, organic ionic materials such as calcium stearate may be added to increase electrical conductivity. See U.S. Pat. No. 6,599,446 (Todt et al.), incorporated herein by reference.

In one embodiment hereof, the electrically conductive bonding substance is luminescent, for example as disclosed in U.S. Pat. No. 6,558,576 (Brielmann et al.), incorporated herein by reference.

EMURFI Shielding

In some embodiments, electroductive bonding substances may be used for EMI (electromagnetic interference) and/or RFI (radio-frequency interference) shielding. Examples of such EMI/RFI shielding are disclosed in U.S. Pat. Nos. 5,087,314 (Sandborn et al.) and 5,700,398 (Angelopoulos et al.), both incorporated herein by reference.

Electrodes

One or more hollow Plasma-shells containing the ionizable gas are located within the display panel structure, each Plasma-shell being in contact with at least two electrodes. In accordance with this invention, the contact is made by an electrically conductive bonding substance applied to each shell so as to form an electrically conductive pad for connection to the electrodes. Each electrode pad may partially cover the outside shell surface of the Plasma-shell. The electrodes and pads may be of any geometric shape or configuration. In one embodiment the electrodes are opposing arrays of electrodes, one array of electrodes being transverse or orthogonal to an opposing array of electrodes. The electrode arrays can be parallel, zig zag, serpentine, or like pattern as typically used in dot-matrix gas discharge (plasma) displays. The use of split or divided electrodes is contemplated as disclosed in U.S. Pat. No. 3,603,836 (Grier), incorporated herein by reference. The electrodes are of any suitable conductive metal or alloy including gold, silver, aluminum, or chrome-copper chrome. If a transparent electrode is used on the viewing surface, this is typically indium tin oxide (ITO) or tin oxide with a conductive side or edge bus bar of silver. Other conductive bus bar materials may be used such as gold, aluminum, or chrome-copper-chrome. The electrodes may partially cover the external surface of the Plasma-shell.

The electrodes may be applied to the substrate or to the Plasma-shells by thin film methods such as vapor phase deposition, E-beam evaporation, sputtering, conductive doping, etc. or by thick film methods such as screen printing, ink jet printing, etc.

In a matrix display, the electrodes in each opposing transverse array are transverse to the electrodes in the opposing array so that each electrode in each array forms a crossover with an electrode in the opposing array, thereby forming a multiplicity of crossovers. Each crossover of two opposing electrodes forms a discharge point or cell. At least one hollow Plasma-shell containing ionizable gas is positioned in the gas discharge (plasma) display device at the intersection of at least two opposing electrodes. When an appropriate voltage potential is applied to an opposing pair of electrodes, the ionizable gas inside of the Plasma-shell at the crossover is energized and a gas discharge occurs. Photons of light in the visible and/or invisible range are emitted by the gas discharge.

Shell Geometry

The shell of the Plasma-shells may be of any suitable volumetric shape or geometric configuration to encapsulate the ionizable gas independently of the PDP or PDP substrate. As used herein, Plasma-shell includes Plasma-sphere, Plasma-disc, and/or Plasma-dome. The volumetric and geometric shapes include but are not limited to spherical, oblate spheroid, prolate spheroid, capsular, elliptical, ovoid, egg shape, bullet shape, pear, and/or tear drop. In an oblate spheroid, the diameter at the polar axis is flattened and is less than the diameter at the equator. In a prolate spheroid, the diameter at the equator is less than the diameter at the polar axis such that the overall shape is elongated. Likewise, the shell cross-section may be of any geometric design.

The size of the Plasma-shell used in the practice of this invention may vary over a wide range. In a gas discharge display, the average diameter of a Plasma-shell is about 1 mil to 20 mils (where one mil equals 0.001 inch) or about 25 microns to 500 microns. Plasma-shells can be manufactured up to 80 mils or about 2000 microns in diameter or greater. The thickness of the wall of each hollow Plasma-shell must be sufficient to retain the gas inside, but thin enough to allow passage of photons emitted by the gas discharge. The wall thickness of the Plasma-shell should be kept as thin as practical to minimize photon absorption, but thick enough to retain sufficient strength so that the Plasma-shells can be easily handled and pressurized.

The average diameter of the Plasma-shells may be varied for different phosphors to achieve color balance. Thus for a gas discharge display having phosphors which emit red, green, and blue light in the visible range, the Plasma-shells for the red phosphor may have an average diameter less than the average diameter of the Plasma-shells for the green or blue phosphor. Typically the average diameter of the red phosphor Plasma-shells is about 80% to 95% of the average diameter of the green phosphor Plasma-shells.

The average diameter of the blue phosphor Plasma-shells may be greater than the average diameter of the red or green phosphor Plasma-shells. Typically the average Plasma-shell diameter for the blue phosphor is about 105% to 125% of the average Plasma-shell diameter for the green phosphor and about 110% to 155% of the average diameter of the red phosphor.

In another embodiment using a high brightness green phosphor, the red and green Plasma-shell may be reversed such that the average diameter of the green phosphor Plasma-shell is about 80% to 95% of the average diameter of the red phosphor Plasma-shell. In this embodiment, the average diameter of the blue Plasma-shell is 105% to 125% of the average Plasma-shell diameter for the red phosphor and about 110% to 155% of the average diameter of the green phosphor.

The red, green, and blue Plasma-shells may also have different size diameters so as to enlarge voltage margin and improve luminance uniformity as disclosed in U.S. Patent Application Publication 2002/0041157 A1 (Heo), incorporated herein by reference. The widths of the corresponding electrodes for each RGB Plasma-shell may be of different dimensions such that an electrode is wider or more narrow for a selected phosphor as disclosed in U.S. Pat. No. 6,034,657 (Tokunaga et al.), incorporated herein by reference. There also may be used combinations of different geometric shapes for different colors. Thus there may be used a square cross section Plasma-shell for one color, a circular cross-section for another color, and another geometric cross section for a third color. A combination of Plasma-shells of different geometric shape, i.e., Plasma-spheres, Plasma-discs, and Plasma-domes, as different pixels in a PDP may be used

Organic Luminescent Substance

Organic luminescent substances may be used alone or in combination with inorganic luminescent substances. Contemplated combinations include mixtures and/or selective layers of organic and inorganic substances.

In accordance with one embodiment of this invention, an organic luminescent substance is located in close proximity to the enclosed gas discharge within a Plasma-shell, so as to be excited by photons from the enclosed gas discharge.

In accordance with the preferred embodiment of this invention, an organic photoluminescent substance is positioned on at least a portion of the external surface of a Plasma-shell, so as to be excited by photons from the gas discharge within the Plasma-shell, such that the excited photoluminescent substance emits visible and/or invisible light.

As used herein organic luminescent substance comprises one or more organic compounds, monomers, dimers, trimers, polymers, copolymers, or like organic materials which emit visible and/or invisible light when excited by photons from the gas discharge inside of the Plasma-shell.

Such organic luminescent substance may include one or more organic photoluminescent phosphors selected from organic photoluminescent compounds, organic photoluminescent monomers, dimers, trimers, polymers, copolymers, organic photoluminescent dyes, organic photoluminescent dopants and/or any other organic photoluminescent material. All are collectively referred to herein as organic photoluminescent phosphor.

Organic photoluminescent phosphor substances contemplated herein include those organic light-emitting diodes or devices (OLED) and organic electroluminescent (EL) materials which emit light when excited by photons from the gas discharge of a gas plasma discharge. OLED and organic EL substances include the small molecule organic EL and the large molecule or polymeric OLED.

Small molecule organic EL substances are disclosed in U.S. Pat. Nos. 4,720,432 (VanSlyke et al.), 4,769,292 (Tang et al.), 5,151,629 (VanSlyke), 5,409,783 (Tang et al.), 5,645,948 (Shi et al.), 5,683,823 (Shi et al.), 5,755,999 (Shi et al.), 5,908,581 (Chen et al.), 5,935,720 (Chen et al.), 6,020,078 (Chen et al.), 6,069,442 (Hung et al.), 6,348,359 (VanSlyke et al.), and 6,720,090 (Young et al.), all incorporated herein by reference. The small molecule organic light-emitting devices may be called SMOLED.

Large molecule or polymeric OLED substances are disclosed in U.S. Pat. Nos. 5,247,190 (Friend et al.), 5,399,502 (Friend et al.), 5,540,999 (Yamamoto et al.), 5,900,327 (Pei et al.), 5,804,836 (Heeger et al.), 5,807,627 (Friend et al.), 6,361,885 (Chou), and 6,670,645 (Grushin et al.), all incorporated herein by reference. The polymer light-emitting devices may be called PLED.

Organic luminescent substances also include OLEDs doped with phosphorescent compounds as disclosed in U.S. Pat. No. 6,303,238 (Thompson et al.), incorporated herein by reference.

Organic photoluminescent substances are also disclosed in U.S. Patent Application Publication Nos. 2002/0101151 (Choi et al.), 2002/0063525 (Choi et al.), 2003/0003225 (Choi et al.), and 2003/0052596 (Yi et al.); U.S. Pat. Nos. 6,610,554 (Yi et al.), and 6,692,326 (Choi et al.); and International Publications WO 02/104077 and WO 03/046649, all incorporated herein by reference.

In one preferred embodiment of this invention, the organic luminescent phosphorous substance is a color-conversion-media (CCM) that converts light (photons) emitted by the gas discharge to visible or invisible light. Examples of CCM substances include the fluorescent organic dye compounds.

In one preferred embodiment, the organic luminescent substance is selected from a condensed or fused ring system such as a perylene compound, a perylene based compound, a perylene derivative, a perylene based monomer, dimer or trimer, a perylene based polymer, and/or a substance doped with a perylene.

Photoluminescent perylene phosphor substances are widely known in the prior art. U.S. Pat. No. 4,968,571 (Gruenbaum et al.), incorporated herein by reference, discloses photoconductive perylene materials which may be used as photoluminescent phosphorous substances.

U.S. Pat. No. 5,693,808 (Langhals), incorporated herein by reference, discloses the preparation of luminescent perylene dyes.

U.S. Patent Application Publication 2004/0009367 (Hatwar), incorporated herein by reference, discloses the preparation of luminescent materials doped with fluorescent perylene dyes.

U.S. Pat. No. 6,528,188 (Suzuki et al.), incorporated herein by reference, discloses the preparation and use of luminescent perylene compounds.

These condensed or fused ring compounds are conjugated with multiple double bonds and include monomers, dimers, trimers, polymers, and copolymers. In addition, conjugated aromatic and aliphatic organic compounds are contemplated including monomers, dimers, trimers, polymers, and copolymers. Conjugation as used herein also includes extended conjugation.

A material with conjugation or extended conjugation absorbs light and then transmits the light to the various conjugated bonds. Typically the number of conjugate-double bonds ranges from about 4 to about 15.

Further examples of conjugate-bonded or condensed/fused benzene rings are disclosed in U.S. Pat. Nos. 6,614,175 (Aziz et al.) and 6,479,172 (Hu et al.), both incorporated herein by reference. U.S. Patent Application Publication 2004/0023010 (Bulovic et al.) discloses luminescent nanocrystals with organic polymers including conjugated organic polymers.

Cumulene is conjugated only with carbon and hydrogen atoms. Cumulene becomes more deeply colored as the conjugation is extended.

Other condensed or fused ring luminescent compounds may also be used including naphthalimides, substituted naphthalimides, naphthalimide monomers, dimers, trimers, polymers, copolymers and derivatives thereof including naphthalimide diester dyes such as disclosed in U.S. Pat. No. 6,248,890 (Likavec et al.), incorporated herein by reference.

The organic luminescent substance may be an organic lumophore, for example as disclosed in U.S. Pat. Nos. 5,354,825 (Klainer et al.), 5,480,723 (Klainer et al.), 5,700,897 (Klainer et al.), and 6,538,263 (Park et al.), all incorporated herein by reference. Also lumophores are disclosed in S. E. Shaheen et al., Journal of Applied Physics, Vol 84, Number 4, pages 2324 to 2327, Aug. 15, 1998; J. D. Anderson et al., Journal American Chemical Society 1998, Vol 120, pages 9646 to 9655; and Gyu Hyun Lee et al., Bulletin of Korean Chemical Society 2002, Vol 23, NO. 3, pages 528 to 530, all incorporated herein by reference.

The organic luminescent substance may be applied by any suitable method to the external surface of the Plasma-shell, to the substrate or to any location in close proximity to the gas discharge contained within the Plasma-shell.

Such methods include thin film deposition methods such as vapor phase deposition, sputtering and E-beam evaporation. Also thick film or application methods may be used such as screen-printing, ink jet printing, and/or slurry techniques.

Small size molecule OLED materials are typically deposited upon the external surface of the Plasma-shell by thin film deposition methods such as vapor phase deposition or sputtering.

Large size molecule or polymeric OLED materials are deposited by so called thick film or application methods such as screen-printing, ink jet, and/or slurry techniques.

If the organic luminescent substance such as a photoluminescent phosphor is applied to the external surface of the Plasma-shell, it may be applied as a continuous or discontinuous layer or coating such that the Plasma-shell is completely or partially covered with the luminescent substance.

Inorganic Luminescent Substances

Inorganic luminescent substances may be used alone or in combination with organic luminescent substances. Contemplated combinations include mixtures and/or selective layers of organic and/or inorganic substances. The shell may be made of inorganic luminescent substance. In one embodiment the inorganic luminescent substance is incorporated into the particles forming the shell structure. Typical inorganic luminescent substances are as follows.

Green Phosphor

A green light-emitting phosphor may be used alone or in combination with other light-emitting phosphors such as blue or red. Phosphor materials which emit green light include $Zn_2SiO_4$:Mn, ZnS:Cu, ZnS:Au, ZnS:Al, ZnO:Zn, CdS:Cu, CdS:$Al_2$, $Cd_2O_2S$:Tb, and $Y_2O_2S$:Tb.

In one mode and embodiment of this invention using a green light-emitting phosphor, there is used a green light-emitting phosphor selected from the zinc orthosilicate phosphors such as $ZnSiO_4:Mn^{2+}$. Green light-emitting zinc orthosilicates including the method of preparation are disclosed in U.S. Pat. No. 5,985,176 (Rao) which is incorporated herein by reference. These phosphors have a broad emission in the green region when excited by 147 nm and 173 nm (nanometers) radiation from the discharge of a xenon gas mixture.

In another mode and embodiment of this invention there is used a green light-emitting phosphor which is a terbium activated yttrium gadolinium borate phosphor such as (Gd, Y) $BO_3:Tb^{3+}$. Green light-emitting borate phosphors including the method of preparation are disclosed in U.S. Pat. No. 6,004,481 (Rao) which is incorporated herein by reference.

In another mode and embodiment there is used a manganese activated alkaline earth aluminate green phosphor as disclosed in U.S. Pat. No. 6,423,248 (Rao et al.), peaking at 516 nm when excited by 147 nm and 173 nm radiation from xenon. The particle size ranges from 0.05 to 5 microns. Rao et al. '248 is incorporated herein by reference Terbium doped phosphors may emit in the blue region especially in lower concentrations of terbium. For some display applications such as television, it is desirable to have a single peak in the green region at 543 nm. By incorporating a blue absorption dye in a filter, any blue peak can be eliminated.

Green light-emitting terbium-activated lanthanum cerium orthophosphate phosphors are disclosed in U.S. Pat. No. 4,423,349 (Nakajima et al.) which is incorporated herein by reference. Green light-emitting lanthanum cerium terbium phosphate phosphors are disclosed in U.S. Pat. No. 5,651,920 (Chau et al.), incorporated herein by reference.

Green light-emitting phosphors may also be selected from the trivalent rare earth ion-containing aluminate phosphors as disclosed in U.S. Pat. No. 6,290,875 (Oshio et al.).

Blue Phosphor

A blue light-emitting phosphor may be used alone or in combination with other light-emitting phosphors such as green or red. Phosphor materials which emit blue light include ZnS:Ag, ZnS:Cl, and CsI:Na.

In a preferred mode and embodiment of this invention, there is used a blue light-emitting aluminate phosphor. An aluminate phosphor which emits blue visible light is divalent europium ($Eu^{2+}$) activated Barium Magnesium Aluminate (BAM) represented by $BaMgAl_{10}O_{17}:Eu^{2+}$. BAM is widely used as a blue phosphor in the PDP industry.

BAM and other aluminate phosphors which emit blue visible light are disclosed in U.S. Pat. No. 5,611,959 (Kijima et al.) and U.S. Pat. No. 5,998,047 (Bechtel et al.), both incorporated herein by reference. The aluminate phosphors may also be selectively coated as disclosed by Bechtel et al. 047.

Blue light-emitting phosphors may be selected from a number of divalent europium-activated aluminates such as disclosed in U.S. Pat. No. 6,096,243 (Oshio et al.) incorporated herein by reference.

The preparation of BAM phosphors for a PDP is also disclosed in U.S. Pat. No. 6,045,721 (Zachau et al.), incorporated herein by reference.

In another mode and embodiment of this invention, the blue light-emitting phosphor is thulium activated lanthanum phosphate with trace amounts of $Sr^{2+}$ and/or $Li^{+}$. This exhibits a narrow band emission in the blue region peaking at 453 nm when excited by 147 nm and 173 nm radiation from the discharge of a xenon gas mixture. Blue light-emitting phosphate phosphors including the method of preparation are disclosed in U.S. Pat. No. 5,989,454 (Rao) which is incorporated herein by reference.

In a best mode and embodiment of this invention using a blue-emitting phosphor, a mixture or blend of blue emitting phosphors is used such as a blend or complex of about 85% to 70% by weight of a lanthanum phosphate phosphor activated by trivalent thulium ($Tm^{3+}$), $Li^{+}$, and an optional amount of an alkaline earth element ($AE^{2+}$) as a coactivator and about 15% to 30% by weight of divalent europium-activated BAM phosphor or divalent europium-activated Barium Magnesium, Lanthanum Aluminated (BLAMA) phosphor. Such a mixture is disclosed in U.S. Pat. No. 6,187,225 (Rao), incorporated herein by reference.

Blue light-emitting phosphors also include $ZnO.Ga_2O_3$ doped with Na or Bi. The preparation of these phosphors is disclosed in U.S. Pat. Nos. 6,217,795 (Yu et al.) and 6,322,725 (Yu et al.), both incorporated herein by reference.

Other blue light-emitting phosphors include europium activated strontium chloroapatite and europium-activated strontium calcium chloroapatite.

Red Phosphor

A red light-emitting phosphor may be used alone or in combination with other light-emitting phosphors such as green or blue. Phosphor materials which emit red light include $Y_2O_2S:Eu$ and $Y_2O_3S:Eu$.

In a best mode and embodiment of this invention using a red-emitting phosphor, there is used a red light-emitting phosphor which is an europium activated yttrium gadolinium borate phosphors such as $(Y,Gd)BO_3:Eu^{3+}$. The composition and preparation of these red light-emitting borate phosphors is disclosed in U.S. Pat. No. 6,042,747 (Rao) and U.S. Pat. No. 6,284,155 (Rao), both incorporated herein by reference.

These europium activated yttrium, gadolinium borate phosphors emit an orange line at 593 nm and red emission lines at 611 nm and 627 nm when excited by 147 nm and 173 nm UV radiation from the discharge of a xenon gas mixture. For television (TV) applications, it is preferred to have only the red emission lines (611 nm and 627 nm). The orange line (593 nm) may be minimized or eliminated with an external optical filter.

A wide range of red light-emitting phosphors are used in the PDP industry and are contemplated in the practice of this invention including europium-activated yttrium oxide.

Other Phosphors

There also may be used phosphors other than red, blue, green such as a white light-emitting phosphor, pink light-emitting phosphor or yellow light-emitting phosphor. These may be used with an optical filter.

Phosphor materials which emit white light include calcium compounds such as $3Ca_3(PO_4)_2.CaF:Sb$, $3Ca_3(PO_4)_2.CaF:Mn$, $3Ca_3(PO_4)_2.CaCl:Sb$, and $3Ca_3(PO_4)_2.CaCl:Mn$.

White light-emitting phosphors are disclosed in U.S. Pat. No. 6,200,496 (Park et al.) incorporated herein by reference.

Pink light-emitting phosphors are disclosed in U.S. Pat. No. 6,200,497 (Park et al.) incorporated herein by reference. Phosphor material which emits yellow light include ZnS:Au.

Organic and Inorganic Luminescent Material

Inorganic and organic luminescent materials may be used in selected combinations.

In one embodiment, multiple layers of luminescent materials are applied to the Plasma-shell with at least one layer being organic and at least one layer being inorganic. An inorganic layer may serve as a protective overcoat for an organic layer.

In another embodiment, the shell of the Plasma-shell comprises or contains inorganic luminescent material. In another embodiment, organic and inorganic luminescent materials are mixed together and applied as a layer inside or outside the shell. The shell may also be made of or contain a mixture of organic and inorganic luminescent materials. In one preferred embodiment, a mixture of organic and inorganic material is applied outside the shell.

Photon Exciting of Luminescent Substance

In the best embodiment contemplated in the practice of this invention, a layer, coating, or particles of inorganic and/or organic luminescent substances such as phosphor is located on the exterior wall of the Plasma-shell. The photons of light pass through the shell or wall(s) of the Plasma-shell and excite the organic or inorganic photoluminescent phosphor located outside of the Plasma-shell. The phosphor may be located on the side wall(s) of a channel, barrier, groove, cavity, well, hollow or like structure of the discharge space.

In one embodiment, the gas discharge within the channel, barrier, groove, cavity, well or hollow produces photons that excite the inorganic and/or organic phosphor such that the phosphor emits light in a range visible to the human eye. Typically this is red, blue, or green light. However, phosphors may be used which emit other light such as white, pink, or yellow light. In some embodiments of this invention, the emitted light may not be visible to the human eye.

In prior art AC plasma display structures as disclosed in U.S. Pat. Nos. 5,793,158 (Wedding) and 5,661,500 (Shinoda), inorganic and/or organic phosphor is located on the wall(s) or side(s) of the barriers that form the channel, groove, cavity, well, or hollow, phosphor may also be located on the bottom of the channel, or groove as disclosed by Shinoda et al. '500 or the bottom cavity, well, or hollow as disclosed by U.S. Pat. No. 4,827,186 (Knauer et al.). The Plasma-shells are positioned within the channel barrier, groove, cavity, well or hollow so as to be in close proximity to the phosphor.

Thus in one embodiment of this invention, Plasma-shells are positioned within the channels, barriers, grooves, cavities, wells, or hollows, such that photons from the gas discharge within the Plasma-shell cause the phosphor along the wall(s), side(s) or at the bottom of the channel, barrier, groove, cavity, well, or hollow, to emit light.

In another embodiment of this invention, phosphor is located on the outside surface of each Plasma-shell. In this embodiment, the outside surface is at least partially covered with phosphor that emits light in the visible or invisible range when excited by photons from the gas discharge within the Plasma-shell.

In one embodiment, phosphor is dispersed and/or suspended within the ionizable gas inside each Plasma-shell. In such embodiment, the phosphor particles are sufficiently small such that most of the phosphor particles remain suspended within the gas and do not precipitate or otherwise substantially collect on the inside wall of the Plasma-shell. The average diameter of the dispersed and/or suspended phosphor particles is less than about 1 micron, typically less than 0.1 microns. Larger particles can be used depending on the size of the Plasma-shell. The phosphor particles may be introduced by means of a fluidized bed.

The luminescent substance such as an inorganic and/or organic photoluminescent phosphor may be located on all or part of the external surface of the Plasma-shells on all or part of the internal surface of the Plasma-shells. The phosphor may comprise particles dispersed or floating within the gas. In one best embodiment contemplated for the practice of this invention, an inorganic and/or organic luminescent phosphor is located on the external surface of the Plasma-shell.

In one embodiment, an inorganic and/or organic luminescent substance is located on the external surface and excited by ultraviolet (UV) photons from the gas discharge inside the Plasma-shell.

The phosphor emits light in the visible range such as red, blue, or green light. Phosphors may be selected to emit light of other colors such as white, pink, or yellow. The phosphor may also be selected to emit light in non-visible ranges of the spectrum. Optical filters may be selected and matched with different phosphors.

The phosphor thickness is sufficient to absorb the UV, but thin enough to emit light with minimum attenuation. Typically the phosphor thickness is about 2 to 40 microns, preferably about 5 to 15 microns.

In one embodiment, dispersed or floating particles within the gas are typically spherical or needle shaped having an average size of about 0.01 to 5 microns.

A UV photoluminescent phosphor is excited by UV in the range of 50 to 400 nanometers. The phosphor may have a protective layer or coating which is transmissive to the excitation UV and the emitted visible light. Such include organic films such as perylene or inorganic films such as aluminum oxide or silica. Protective coatings are disclosed and discussed below.

Because the ionizable gas is contained within a multiplicity of Plasma-shells, it is possible to provide a custom gas mixture or composition at a custom pressure in each Plasma-shell for each phosphor.

In the prior art, it is necessary to select an ionizable gas mixture and a gas pressure that is optimum for all phosphors used in the device such as red, blue, and green phosphors. However, this requires trade-offs because a particular gas mixture may be optimum for a particular green phosphor, but less desirable for red or blue phosphors. In addition, trade-offs are required for the gas pressure.

In the practice of this invention, an optimum gas mixture and an optimum gas pressure may be provided for each of the selected phosphors. Thus the gas mixture and gas pressure inside the Plasma-shells may be optimized with a custom gas mixture and a custom gas pressure, each or both optimized for each phosphor emitting red, blue, green, white, pink, or yellow light in the visible range or light in the invisible range. The diameter and the wall thickness of the Plasma-shell can also be adjusted and optimized for each phosphor. Depending upon the Paschen Curve (pd v. voltage) for the particular ionizable gas mixture, the operating voltage may be decreased by optimized changes in the gas mixture, gas pressure, and the diameter of the Plasma-shell.

Up-conversion

In one embodiment, there is used an inorganic and/or organic luminescent substance such as a phosphor for up-conversion, for example to convert infrared radiation to visible light. Up-conversion materials including phosphors are disclosed in U.S. Pat. Nos. 5,541,012 (Ohwaki et al.), 6,028,977 (Newsome), 6,265,825 (Asano), and 6,624,414 (Glesener), all incorporated herein by reference. Up-conversion may also be obtained with shell compositions such as thulium doped silicate glass containing oxides of Si, Al, and La, as disclosed in U.S. Patent Application Publication 2004/0037538 (Schardt et al.), incorporated herein by reference. The glasses of Schardt et al. '538 emit visible or UV light when excited by IR. Glasses for up-conversion are also disclosed in Japanese Patent Publications 9054562 (Akira et al.) and 9086958 (Akira et al.), both incorporated herein by reference.

U.S. Pat. No. 5,166,948 (Gavrilovic et al.), incorporated herein by reference, discloses an up-conversion crystalline structure. U.S. Pat. No. 5,290,730 (McFarlane et al.) discloses a single crystal halide-based up-conversion substance. It is contemplated that the shell may be constructed wholly or in part from an up-conversion material, down-conversion material or a combination of both.

Down-conversion

The luminescent material may also include down-conversion materials including phosphors as disclosed in U.S. Pat. Nos. 6,013,538 (Burrows et al.), 6,091,195 (Forrest et al.), 6,208,791 (Bischel et al.), 6,534,916 (Ito et al.), 6,566,156

(Sturm et al.), 6,650,045 (Forrest et al.), and 7,141,920 (Oskam et al.), all incorporated herein by reference. As noted above, the shell may be constructed wholly or in part from a down-conversion material, up-conversion material or a combination of both.

Both up-conversion and down-conversion materials are disclosed in U.S. Pat. Nos. 3,623,907 (Watts), 3,634,614 (Geusic et al.), 3,838,307 (Masi), and U.S. Patent Application Publication Nos. 2004/0159903 (Burgener, II et al.), 2004/0196538 (Burgener, II et al.), and 2005/0094109 (Sun et al.), all incorporated herein by reference. U.S. Pat. No. 6,726,992 (Yadav et al.), incorporated herein by reference, discloses nano-engineered luminescent materials including both up-conversion and down-conversion phosphors.

Quantum Dots

In one embodiment of this invention, the luminescent substance is a quantum dot material. Examples of luminescent quantum dots are disclosed in International Publication Numbers WO 03/038011, WO 00/029617, WO 03/038011, WO 03/100833, and WO 03/037788, all incorporated herein by reference.

Luminescent quantum dots are also disclosed in U.S. Pat. Nos. 6,468,808 (Nie et al.), 6,501,091 (Bawendi et al.), 6,696,313 (Park et al.), and published U.S. Patent Application Publication 2003/0042850 (Bertram et al.), all incorporated herein by reference. The quantum dots may be added or incorporated into the shell during shell formation or after the shell is formed.

Protective Overcoat

In a preferred embodiment, the luminescent substance is located on an external surface of the Plasma-shell. Organic luminescent phosphors are particularly suitable for placing on the exterior shell surface, but may require a protective overcoat. The protective overcoat may be inorganic, organic, or a combination of inorganic and organic. This protective overcoat may be an inorganic and/or organic luminescent material.

The luminescent substance may have a protective overcoat such as a clear or transparent acrylic compound including acrylic solvents, monomers, dimers, trimers, polymers, copolymers, and derivatives thereof to protect the luminescent substance from direct or indirect contact or exposure with environmental conditions such as air, moisture, sunlight, handling, or abuse. The selected acrylic compound is of a viscosity such that it can be conveniently applied by spraying, screen print, ink jet, or other convenient methods so as to form a clear film or coating of the acrylic compound over the luminescent substance.

Other organic compounds may also be suitable as protective overcoats including silanes such as glass resins. Also the polyesters such as Mylar® may be applied as a spray or a sheet fused under vacuum to make it wrinkle free. Polycarbonates may be used but may be subject to UV absorption and detachment.

In one embodiment hereof the luminescent substance is coated with a film or layer of a perylene compound including monomers, dimers, trimers, polymers, copolymers, and derivatives thereof. The perylene compounds are widely used as protective films. Specific compounds include poly-monochloro-para-xylyene (Parylene C) and poly-para-xylylene (Parylene N).

Parylene polymer films are also disclosed in U.S. Pat. No. 5,879,808 (Wary et al.) and 6,586,048 (Welch, Jr. et al.), both incorporated herein by reference. The perylene compounds may be applied by ink jet printing, screen printing, spraying, and so forth as disclosed in U.S. Patent Application Publication 2004/0032466 (Deguchi et al.), incorporated herein by reference. Parylene conformal coatings are covered by Mil-I-46058C and ISO 9002.

Parylene films may also be induced into fluorescence by an active plasma as disclosed in U.S. Pat. No. 5,139,813 (Yira et al.), incorporated herein by reference.

Phosphor overcoats are also disclosed in U.S. Pat. Nos. 4,048,533 (Hinson et al.), 4,315,192 (Skwirut et al.), 5,592,052 (Maya et al.), 5,604,396 (Watanabe et al.), 5,793,158 (Wedding), and 6,099,753 (Yoshimura et al.), all incorporated herein by reference.

In some embodiments, the luminescent substance is selected from materials that do not degrade when exposed to oxygen, moisture, sunlight, etc. and that may not require a protective overcoat. Such include various organic luminescent substances such as the perylene compounds disclosed above. For example, perylene compounds may be used as protective overcoats and thus do not require a protective overcoat.

Specific Organic Phosphor Embodiments and Applications

In this invention, Plasma-shells of any gas encapsulating geometric shape may be used as the pixel elements of a gas plasma display. A full color display is achieved using red, green, and blue pixels. The following are some specific embodiments using an organic luminescent substance such as a luminescent phosphor.

Color Plasma Displays Using UV 300 nm To 380 nm Excitation With Organic Phosphors The organic luminescent substance such as an organic phosphor may be excited by UV ranging from about 300 nm to about 380 nm to produce red, blue, or green emission in the visible range. The encapsulated gas is chosen to excite in this range.

To improve life, the organic phosphor must be separated from the plasma discharge. This may be done by applying the organic phosphor to the exterior of the shell. In this case, it is important that the shell material be selected such that it is transmissive to UV in the range of about 300 nm to about 380 nm. Suitable materials include aluminum oxides, silicon oxides, and other such materials. In the case where helium is used in the gas mixture, aluminum oxide is a desirable shell material as it does not allow the helium to permeate.

Color Plasma Displays Using UV Excitation Below 300 nm With Organic Phosphors Organic phosphors may be excited by UV below 300 nm. In this case, a xenon neon mixture of gases may produce excitation at 147 nm and 172 nm. The Plasma-shell material must be transmissive below 300 nm. Shell materials that are transmissive to frequencies below 300 nm include silicon oxide. The thickness of the shell material must be minimized in order to maximize transmissivity.

Color Plasma Displays Using Visible Blue Above 380 nm With Organic Phosphors

Organic phosphors may be excited by excitation above 380 nm. The Plasma-shell material is composed completely or partially of an inorganic blue phosphor such as BAM. The shell material fluoresces blue and may be up-converted to red or green with organic phosphors on the outside of the shell.

Infrared Plasma Displays

In some applications it may be desirable to have PDP displays with Plasma-shells that produce emission in the infrared range for use in night vision applications. This may be done with Up-Conversion phosphors as described above.

Application of Organic Phosphors

Organic phosphors may be added to a UV curable medium and applied to the Plasma-shell with a variety of methods including jetting, spraying, sheet transfer methods, or screen printing. This may be done before or after the Plasma-shell is added to a substrate or back plate.

Application of Phosphor before Plasma-shells are added to substrate

If organic phosphors are applied to the Plasma-shells before such are applied to the substrate, additional steps may be necessary to place each Plasma-shell in the correct position on the back substrate.

Application of Phosphor after Plasma-shells are added to substrate

If the organic phosphor is applied to the Plasma-shells after such are placed on a substrate, care must be taken to align the appropriate phosphor color with the appropriate Plasma-shell.

Application of Phosphor after Plasma-shells are added to substrate—self-aligning In one embodiment, the Plasma-shells may be used to cure the phosphor. A single color organic phosphor is completely applied to the entire substrate containing the Plasma-shells. Next the Plasma-shells are selectively activated to produce UV to cure the organic phosphor. The phosphor will cure on the Plasma-shells that are activated and may be rinsed away from the Plasma-shells that were not activated. Additional applications of phosphor of different colors may be applied using this method to coat the remaining shells. In this way the process is completely self-aligning.

Tinted Plasma-shells

In the practice of this invention, the Plasma-shell may be color tinted or constructed of materials that are color tinted with red, blue, green, yellow, or like pigments. This is disclosed in U.S. Pat. No. 4,035,690 (Roeber) cited above and incorporated herein by reference. The gas discharge may also emit color light of different wavelengths as disclosed in Roeber '690.

The use of tinted materials and/or gas discharges emitting light of different wavelengths may be used in combination with the above described phosphors and the light emitted from such phosphors. Optical filters may also be used.

High Resolution Color Display

In a multicolor display such as RGB PDP, Plasma-shells with flat sides such as Plasma-discs may be stacked on top of each other or arranged in parallel side by side positions on the substrate. This configuration requires less area of the display surface compared to conventional RGB displays that require red, green, and blue pixels adjacent to each other on the substrate. This stacking embodiment may be practiced with Plasma-shells that use various color emitting gases such as the excimer gases. Phosphor coated Plasma-shells in combination with excimers may also be used. The Plasma-shells used in this stacking arrangement typically have geometric shapes with one or more flat sides such as Plasma-discs and/or Plasma-domes. A Plasma-disc is a Plasma-shell with at least two flattened sides. The other four sides may be flat. A Plasma-dome is a Plasma-shell with a flattened bottom and a domed top. The other four sides may be round or flat. In some stacking embodiments, other flat-sided shapes may also be used.

SUMMARY

Aspects of this invention may be practiced with a coplanar or opposing substrate PDP as disclosed in the U.S. Pat. Nos., 5,793,158 (Wedding) and 5,661,500 (Shinoda et al.) or with a single-substrate or monolithic PDP as disclosed in the U.S. Pat. Nos. 3,646,384 (Lay), 3,860,846 (Mayer), 3,935,484 (Dick et al.) and other single substrate patents, discussed above and incorporated herein by reference.

In the practice of this invention, the Plasma-shells may be positioned and spaced in an AC gas discharge plasma display structure so as to utilize and take advantage of the positive column of the gas discharge. The positive column is described in U.S. Pat. No. 6,184,848 (Weber) and is incorporated herein by reference. In a positive column application, the Plasma-shells must be sufficient in length to accommodate the positive column discharge.

Although this invention has been disclosed and described above with reference to dot matrix gas discharge displays, it may also be used in an alphanumeric gas discharge display using segmented electrodes. This invention may also be practiced in AC or DC gas discharge displays including hybrid structures of both AC and DC gas discharge.

The Plasma-shells may contain a gaseous mixture for a gas discharge display or may contain other substances such as an electroluminescent (EL) or liquid crystal materials for use with other displays technologies including electroluminescent displays (ELD), liquid crystal displays (LCD), field emission displays (FED), electrophoretic displays, and Organic EL or Organic LED (OLED).

The use of Plasma-shells on a single flexible substrate allows the encapsulated pixel display device to be utilized in a number of applications. In one application, the device is used as a plasma shield to absorb electromagnetic radiation and to make the shielded object invisible to enemy radar. In this embodiment, a flexible sheet of Plasma-shells may be provided as a blanket over the shielded object.

In another embodiment, the PDP device is used to detect radiation such as nuclear radiation from a nuclear device, mechanism, apparatus or container. This is particularly suitable for detecting hidden nuclear devices at airports, loading docks, bridges, and other such locations.

The foregoing description of various preferred embodiments of the invention has been presented for purposes of illustration and description. It is not intended to be exhaustive or to limit the invention to the precise forms disclosed. Obvious modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims to be interpreted in accordance with the breadth to which they are fairly, legally, and equitably entitled.

The invention claimed is:

1. A process for producing a Plasma-shell filled with an ionizable gas for use in a gas discharge device, which process comprises:

coating an organic core with an aqueous and/or organic suspension of binder and inorganic particles to form a green porous shell of inorganic particles and binder, heating the green shell to a temperature sufficient to remove the organic core and form a hollow bisque porous shell, submerging the hollow bisque porous shell in a pressurized atmosphere of the ionizable gas so as to fill the hollow shell with the gas, and heating the gas submerged shell to a temperature sufficient to sinter and seal the hollow gas filled shell and retain the ionizable gas within the sintered and sealed shell.

2. The process of claim 1 wherein the organic core is precoated with at least one layer of at least one selected material prior to the coating of the core with the suspension of inorganic particles.

3. The process of claim 2 wherein the at least one selected material is a secondary electron emission material.

4. The process of claim 3 wherein the secondary electron emission material is magnesium oxide, lead oxide, and/or a rare earth oxide.

5. The process of claim 2 wherein the at least one selected material is a luminescent substance.

6. The process of claim 2 wherein there is a first precoat of the core with a secondary electron emission material and a second precoat of a luminescent substance over the first precoat.

7. The process of claim 1 wherein the ionizable gas is one or more gases selected from helium, argon, xenon, krypton, neon, nitrogen, hydrogen, deuterium, tritium, and/or an excimer.

8. The process of claim 1 wherein the inorganic particles are selected from one or more inorganic compounds of metals and/or metalloids.

9. The process of claim 1 wherein the inorganic particles are selected from one or more ceramic, glass, glass ceramic, refractory, fused silica, quartz or mixtures thereof.

10. The process of claim 1 wherein the inorganic particles are selected from one or more oxides, carbides, nitrides, nitrates, silicates, aluminates, phosphates, and borates of metals and/or metalloids.

11. The process of claim 1 wherein the inorganic particles are selected from one or more silicates of aluminum, magnesium, and/or zirconium.

12. The process of claim 1 wherein the inorganic particles are selected from one or more carbides of silicon and/or zirconium.

13. The process of claim 1 wherein the inorganic particles are selected from one or more oxides of silicon, aluminum, magnesium, zirconium, yttrium, and/or cobalt.

14. The process of claim 1 wherein the Plasma-shell is coated with an organic and/or inorganic luminescent material after gas filling, sintering, and sealing.

15. The process of claim 1 wherein the Plasma-shell is made from inorganic luminescent particles.

* * * * *